US011957290B2

(12) United States Patent
Büsing et al.

(10) Patent No.: US 11,957,290 B2
(45) Date of Patent: Apr. 16, 2024

(54) DISHWASHER

(71) Applicant: Samsung Electronics Co., Ltd., Suwon-si (KR)

(72) Inventors: Johannes Büsing, Suwon-si (KR); Kyuha Lee, Suwon-si (KR); Jusik Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/858,249

(22) Filed: Apr. 24, 2020

(65) Prior Publication Data

US 2020/0337519 A1 Oct. 29, 2020

(30) Foreign Application Priority Data

Apr. 25, 2019 (KR) ..... 10-2019-0048527

(51) Int. Cl.
*A47L 15/42* (2006.01)
*A47L 15/10* (2006.01)

(52) U.S. Cl.
CPC ..... *A47L 15/4223* (2013.01); *A47L 15/10* (2013.01); *A47L 15/4217* (2013.01)

(58) Field of Classification Search
CPC ..... A47L 15/4223; E03C 1/1814
See application file for complete search history.

(56) References Cited

U.S. PATENT DOCUMENTS 8,985,128 B2 3/2015 Pyo et al.
2009/0266427 A1 10/2009 Haltmayer
2010/0156256 A1* 6/2010 Haltmayer ..... A47L 15/4217 312/228
2012/0255329 A1* 10/2012 Wanweerakul ..... F16L 11/118 68/208
2014/0265769 A1 9/2014 Vogus
2015/0115784 A1* 4/2015 Busing ..... A47L 15/4223 312/228

(Continued)

FOREIGN PATENT DOCUMENTS

DE 10 2011 089 625 A1 6/2013
EP 1 167 856 A1 1/2002
EP 1 543 760 A2 6/2005

(Continued)

OTHER PUBLICATIONS

KR20080064763—Machine Translation (Year: 2008).*

(Continued)

*Primary Examiner* — Marc Lorenzi
(74) *Attorney, Agent, or Firm* — STAAS & HALSEY LLP

(57) ABSTRACT

A dishwasher includes a main body, a tub provided inside the main body and configured to form a washing chamber, a machine room formed under the tub, a drain hose configured to discharge washing water stored in the washing chamber, and a hose fixer disposed on a side surface of the tub and configured to fix at least a part of the drain hose, and the drain hose further includes a first coupler coupled to one side of the machine room and a second coupler coupled to the hose fixer, and the first coupler includes an insertion part provided to extend in a longitudinal direction of the first coupler to be inserted to the one side of the machine room to couple the first coupler to the one side of the machine room.

11 Claims, 17 Drawing Sheets

(56) References Cited

U.S. PATENT DOCUMENTS

2017/0067200 A1* 3/2017 Kim ..... D06F 37/26

FOREIGN PATENT DOCUMENTS

| | | | | |
|---|---|---|---|---|
| EP | 1 543 760 | A3 | | 1/2006 |
| EP | 2886035 | A1 | | 6/2015 |
| EP | 2 886 035 | B1 | | 3/2017 |
| FR | 2 968 531 | A1 | | 6/2012 |
| KR | 20030092186 | A | * | 12/2003 |
| KR | 10-2006-0085967 | | | 7/2006 |
| KR | 10-2008-0064763 | | | 7/2008 |
| KR | 20080064763 | A | * | 7/2008 |
| KR | 10-1165627 | | | 7/2012 |
| KR | 10-1634172 | | | 6/2016 |
| KR | 10-2016-0144521 | | | 12/2016 |
| WO | WO-2015185097 | A1 | * | 12/2015 ..... F16L 3/13 |

OTHER PUBLICATIONS

KR20030092186—Machine Translation (Year: 2003).*

Iinternational Search Report dated Aug. 20, 2020 in International Patent Application No. PCT/KR2020/005444.

Supplemental European Search Report dated Feb. 21, 2022 in European Application No. 20 79 5500.

Office action dated Apr. 20, 2023 issued in India Patent Application No. 202117038419.

Office Action dated Dec. 12, 2023 issued in European Application No. 20 795 500.6.

Office Action dated Nov. 20, 2023 issued in Korean Application No. 10- 2019-0048527.

* cited by examiner

DISHWASHER

CROSS-REFERENCE TO RELATED APPLICATIONS

This application is based on and claims priority under 35 U.S.C. § 119 to Korean Patent Application No. 10-2019-0048527, filed on Apr. 25, 2019, in the Korean Intellectual Property Office, the disclosure of which is incorporated by reference herein in its entirety.

BACKGROUND

1. Field

The disclosure relates to a dishwasher, and more particularly, to a dishwasher including an improved fixing structure of a drain hose.

2. Description of the Related Art

A dishwasher is a device that automatically cleans food residues on dishes using detergent and washing water.

The dishwasher includes a main body, a washing chamber formed by a tub disposed inside the main body, a storage container disposed inside the washing chamber to accommodate dishes, and an injection unit configured to spray washing water to the storage container.

The storage container is usually provided in two or three stages. In order to spray the washing water to a place where each storage container is positioned, the injection unit may be provided in plural and arranged in accordance with the storage container.

The dishwasher may include a drain hose in order that the washing water sprayed from the inside of the washing chamber is discharged to the outside after washing of the dishes is finished.

In order to prevent the backflow in the drain hose, at least a portion of the drain hose may need to be arranged to have a curved shape at a position higher than a lower surface of the washing chamber.

The conventional dishwasher has at least three additional components to allow the drain hose to have the above-mentioned shape and to be fixed to the inside thereof.

SUMMARY

Therefore, it is an aspect of the disclosure to provide a dishwasher including an improved coupling structure of a drain hose.

It is another aspect of the disclosure to provide a dishwasher having improved assembly of a drain hose.

It is another aspect of the disclosure to provide a dishwasher including a coupling member having improved strength against external force, wherein the coupling member is configured to fix a drain hose to the inside of the dishwasher.

Additional aspects of the disclosure will be set forth in part in the description which follows and, in part, will be apparent from the description, or may be learned by practice of the disclosure.

In accordance with an aspect of the disclosure, a dishwasher includes a main body, a tub provided inside the main body and configured to form a washing chamber, a machine room formed under the tub, a drain hose configured to discharge washing water stored in the washing chamber, and a hose fixing member disposed on a side surface of the tub and configured to fix at least a part of the drain hose, and the drain hose further includes a first coupler coupled to one side of the machine room and a second coupler coupled to the hose fixer, and the first coupler includes an insertion part provided to extend in a longitudinal direction of the first coupler to be inserted to the one side of the machine room to couple the first coupler to the one side of the machine room.

The first coupler may be coupled to the one side of the machine room in an up and down direction with respect to a ground.

The dishwasher may further include a lower frame disposed below the tub and configured to form at least one side of the machine room, and the lower frame may include a lower surface part configured to form a lower surface of the machine room, and a side surface part configured to form at least a part of a side surface of the machine room and provided to extend in an upward direction from the lower surface part, and the first coupler may be coupled to the side surface part.

The side surface part may include a slit to which the insertion part is inserted, and the insertion part may include a support hook hooked to an inside of the slit to prevent the insertion part from being separated from the slit when the insertion part is inserted into the slit.

The slit may be provided to be cut out in an up and down direction with respect to a ground, and the insertion part may be inserted to the silt from an upper side of the slit to a lower side.

The first coupler may further include a guide part configured to guide the insertion part to the slit when the insertion part is inserted into the slit, and the side surface part may further include a guide rail to which the guide part is inserted and slides in a downward direction toward the lower surface to guide the insertion part to be inserted into the slit from the upper side of the slit to the lower side of the slit.

The first coupler may include a body configured to surround an outer circumferential surface of at least a part of the drain hose.

The first coupler may further include a rib provided to extend from an outer circumferential surface of the body to the insertion part so as to connect the body to the insertion part.

The first coupler may be integrally formed with the drain hose.

The first coupler may be attachable to or detachable from the drain hose.

The drain hose may include a first drain hose including a first end coupled to the washing chamber and a second end coupled to a first end of the first coupler, and a second drain hose including a first end connected to a second end end of the first coupler and a second end connected to outside.

The second drain hose may include an intermediate part connected to the second end of the first coupler, and the intermediate part may be bented to allow a first end thereof connected to the first coupler and a second end thereof connected to the second drain hose so that the first end and the second end is perpendicular to each other.

The first coupler may be formed of a material having a greater strength than a strength of the intermediate part.

The dishwasher may further include an air brake assembly configured to supply washing water and air into the tub, and the hose fixer may be disposed in a lower side of the air brake assembly.

The air brake assembly may further include a supply hose to which washing water is supplied from the outside, and a distance between the second end of the second drain hose and a section of the first drain hose extending in the up and down direction is less than a distance between the second end of the second drain hose and a section of the supply hose extending in the up and down direction.

In accordance with another aspect of the disclosure, a dishwasher includes a main body, a tub provided inside the main body and configured to form a washing chamber, a lower frame arranged below the tub, a drain hose configured to discharge washing water stored in the washing chamber, and a hose fixer configured to allow at least a part of the drain hose to be fixed to an upper side than a lower surface of the tub, and the drain hose further includes a hose body, and a coupler configured to surround at least a part of the hose body and coupled to one side of the lower frame, and the coupler is coupled to the one side of the lower frame in an up and down direction with respect to a ground.

The drain hose may include a first drain hose including a first end coupled to the washing chamber and a second end coupled to a first end of the coupler, and a second drain hose including a first end connected to a second end of the coupler and a second end connected to outside.

The second drain hose may include an intermediate part connected to the coupler, and the intermediate part may be configured to allow the other end of the first drain hose and the one end of the second drain hose to be arranged perpendicular to each other.

The coupler may include a body provided to extend in an extending direction of the coupler and coupled to the first drain hose, and an insertion part inserted to one side of the lower frame from an upper side to a lower side, and the lower frame may include a slit arranged on one side of the lower frame and formed by being cut out in the up and down direction to allow the insertion part to be inserted thereto.

In accordance with another aspect of the disclosure, a dishwasher includes a main body, a tub provided inside the main body and configured to form a washing chamber, a lower frame disposed below the tub, a drain hose configured to discharge washing water stored in the washing chamber and including a first part and a second part longer than the first part, and a hose fixer arranged on a side surface of the tub, and configured to fix the first part, and the lower frame includes a lower surface part configured to form a lower surface of the main body, and a side surface part configured to extend in an up and down direction with respect to a ground from the lower surface part, and the side surface part surrounds at least a part of the second part to allow the second part to be coupled to the side surface part in the up and down direction.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
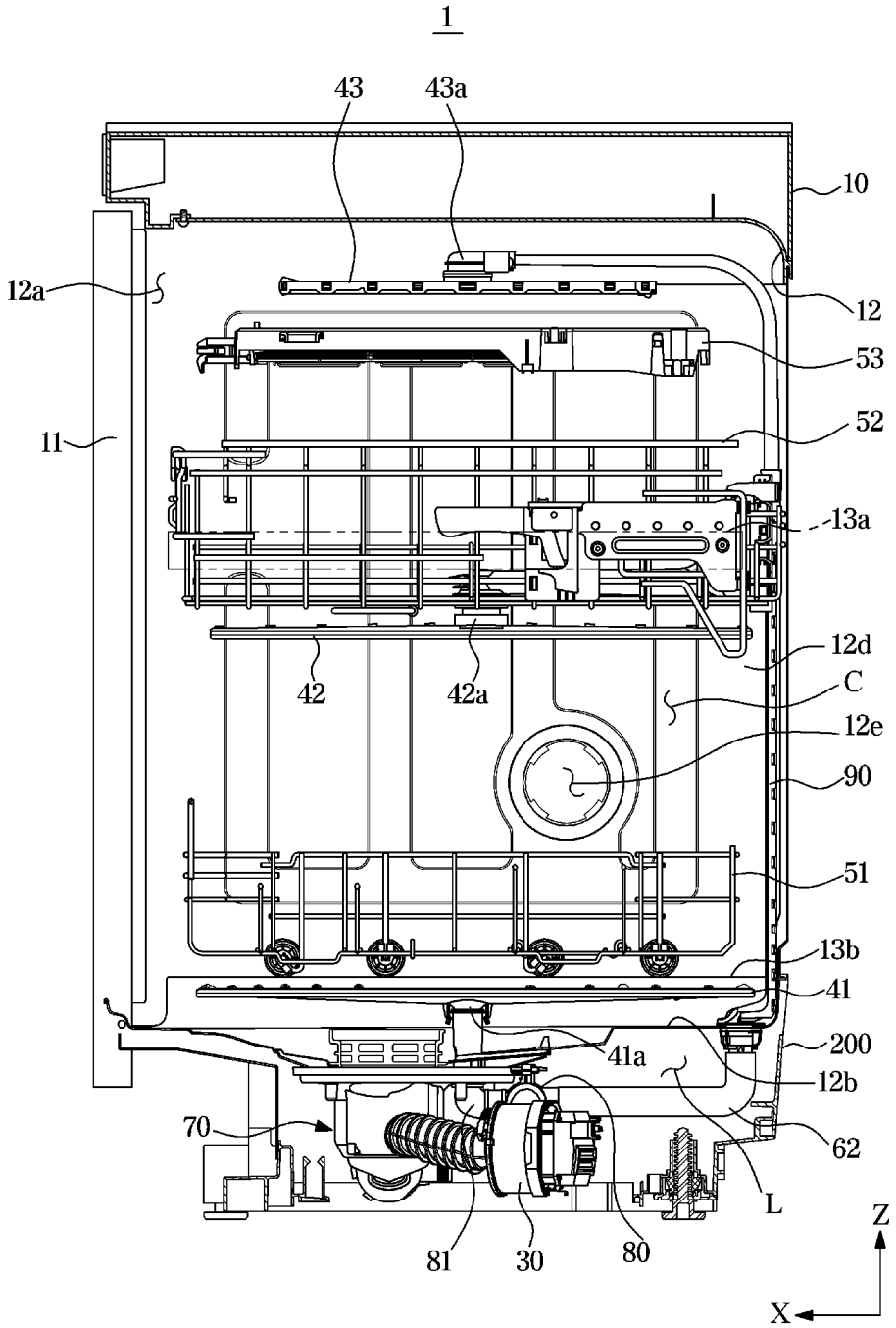
FIG. 1 is a schematic longitudinal sectional view of a dishwasher according to a first embodiment of the disclosure.

Hereinafter embodiments of the disclosure will be described with reference to drawings. In the following detailed description, the terms of "front end", "rear end", "upper portion", "lower portion", "upper end", "lower end" and the like may be defined by the drawings, but the shape and the location of the component is not limited by the term.

Hereinafter dishes may be used as a concept including a bowl, a cup, a cutlery, and various cooking utensils.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Figure 2:
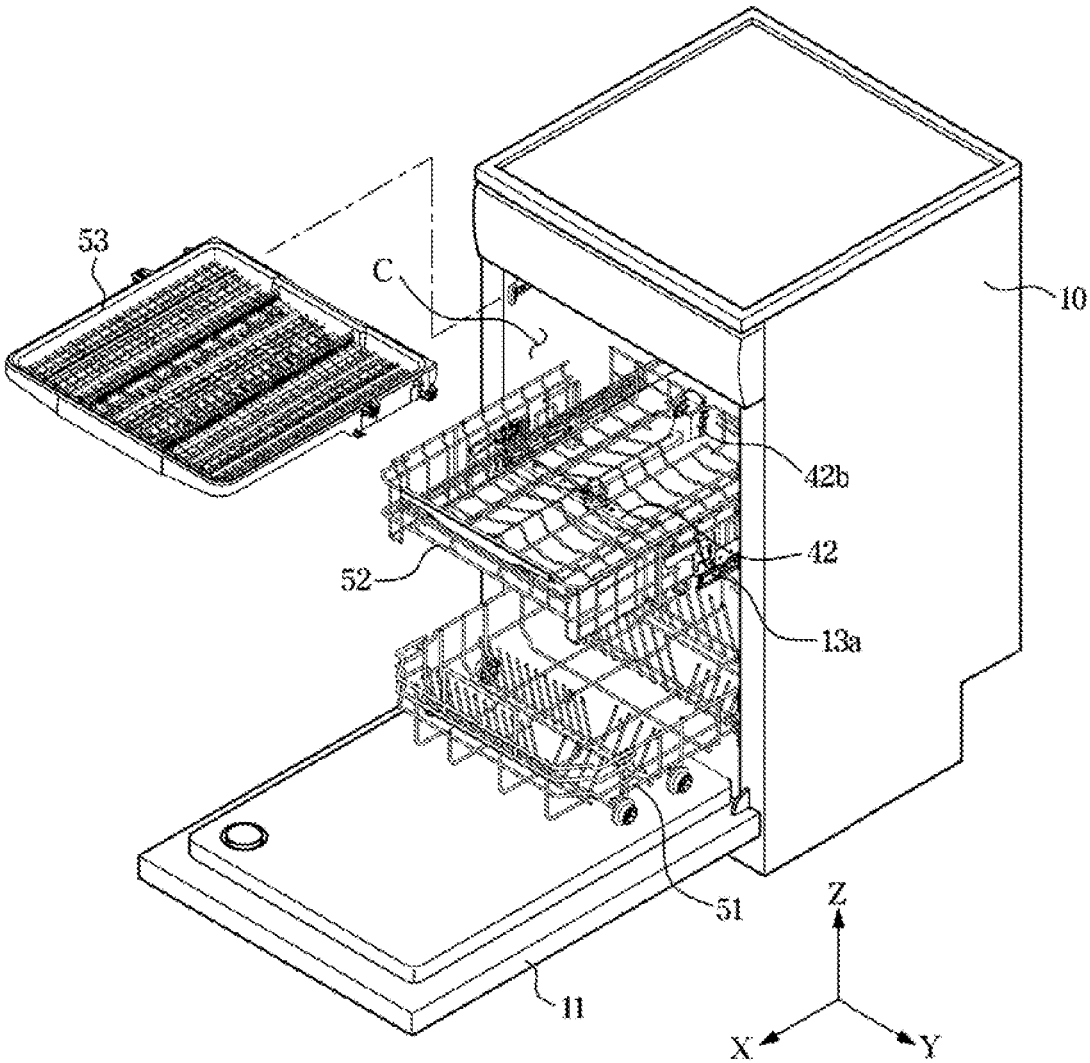
FIG. 2 is a perspective view of the dishwasher according to the first embodiment of the disclosure.
Figure 3:
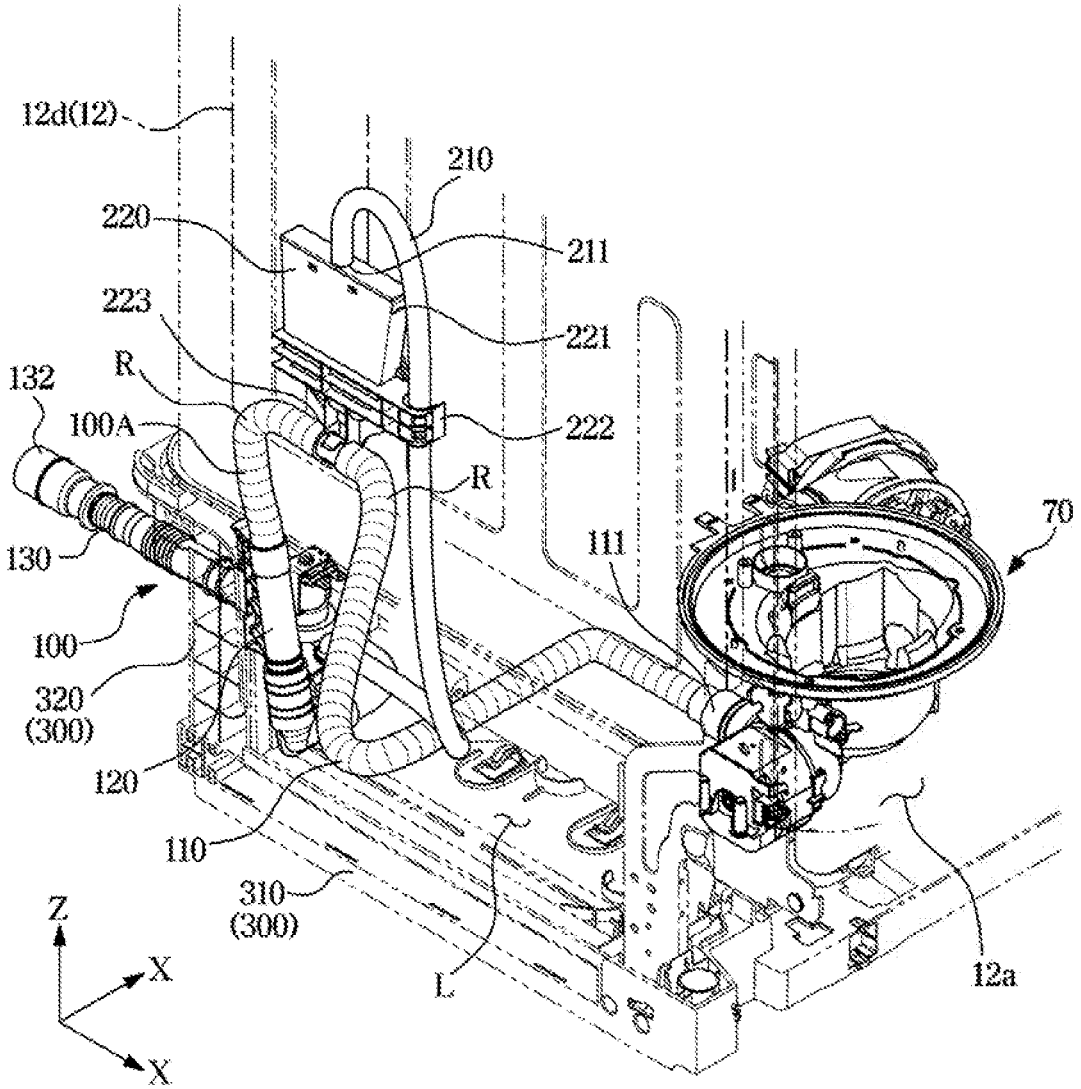
FIG. 3 is a perspective view of some components of the dishwasher according to the first embodiment of the disclosure.
Figure 4:
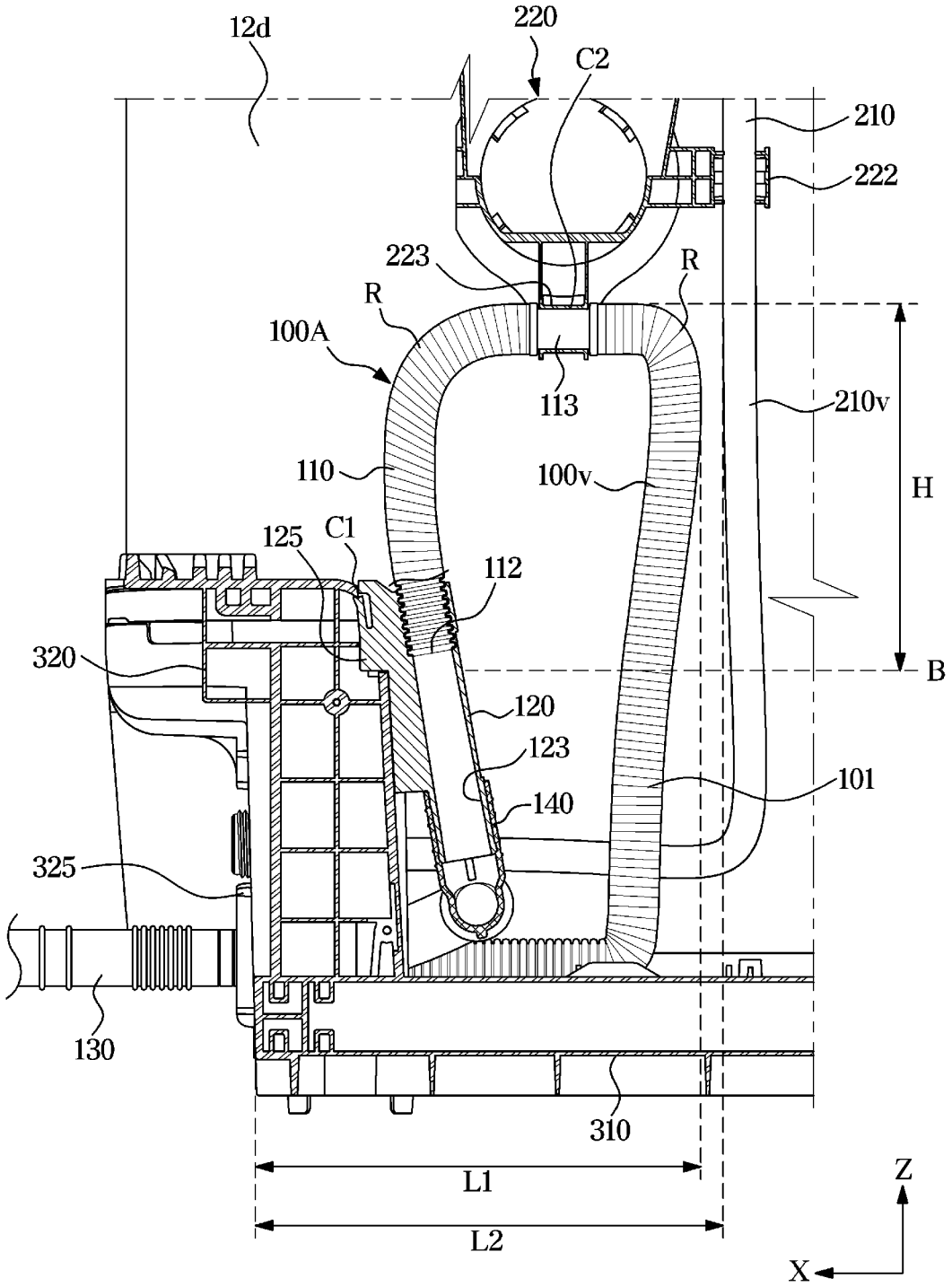
FIG. 4 is a side view of some components of the dishwasher according to the first embodiment of the disclosure.

FIG. 1 is a cross-sectional view of a dishwasher according to a first embodiment of the disclosure, FIG. 2 is a perspective view of the dishwasher according to the first embodiment of the disclosure, FIG. 3 is an exploded perspective view of some components of the dishwasher according to the first embodiment of the disclosure, and FIG. 4 is a side view of some components of the dishwasher according to the first embodiment of the disclosure.

As illustrated in FIGS. 1 and 2, the dishwasher 1 may include a main body 10 forming an appearance thereof.

The dishwasher 1 may further include a tub 12 provided inside the main body 10. The tub 12 may be provided in a substantially box shape. One side of the tub 12 may be openable. That is, the tub 12 may have an opening 12*a*. As an example, a front surface of the tub 12 may be openable.

The dishwasher 1 may further include a door 11 configured to open and close the opening 12*a* of the tub 12. The door 11 may be installed in the main body 10 to open and close the opening 12*a* of the tub 12. The door 11 may be installed in the main body 10 to be rotatable.

The dishwasher 1 may further include a storage container provided in the tub 12 to accommodate dishes.

The storage container may include a plurality of baskets 51 and 52, 53. Relatively large dishes may be stored in the plurality of baskets 51 and 52 However, the kind of dishes accommodated in the plurality of baskets 51, 52, and 53 is not limited to relatively large dishes. That is, the plurality of baskets 51, 52 and 53 may accommodate not only relatively large dishes but also relatively small dishes.

The plurality of baskets 51, 52, and 53 may include an intermediate basket 52 positioned in the middle of the height of the dishwasher 1, and a lower basket 51 positioned in a lower portion in the height direction of the dishwasher 1. The intermediate basket 52 may be provided to be supported by an intermediate guide rack 13*a*, and the lower basket 51 may be provided to be supported by a lower guide rack 13*b*. The intermediate guide rack 13*a* and the lower guide rack 13*b* may be installed on a side surface 12*d* of the tub 12 so as to be slidable toward the opening 12*a* of the tub 12. The side surface 12*d* of the tub 12 may be a concept including an inner surface of a right wall and an inner surface of a left wall of the tub 12.

The storage container may include an upper basket 53 positioned in an upper portion of the height of the dishwasher 1. The upper basket 53 may be formed in a rack assembly to accommodate relatively small dishes. It is appropriate that the upper basket 53 may contain a cooking utensil such as a ladle, a knife, or a turner, or cutlery. In addition, the rack assembly may accommodate a small cup such as an espresso cup. However, the kind of dishes accommodated in the upper basket 53 is not limited to the above example.

In addition, the configuration of the baskets is not limited thereto, and thus according to the size of the tub 12, the upper basket 53 may not be included. Therefore, the storage container may be implemented only with the intermediate basket 52 and the lower basket 51.

The dishwasher 1 may further include a sump 70 configured to store the washing water. The dishwasher 1 may include a washing chamber C corresponding to a space formed by the inside of the tub 12.

The washing chamber C is a space in which the dishes placed in the baskets 51, 52, and 53 are washed by the washing water and then dried.

The washing chamber C may be defined as an inner space of the tub 12 formed by the side surface 12*d*, a front and rear surface, a lower surface 12*b* of the tub, and the sump 70 connected to the lower surface 12*b* of the tub.

The dishwasher 1 may further include injection units 41, 42, and 43 configured to spray washing water. The injection units 41, 42, and 43 may include a first injection unit 41 disposed below the lower basket 51 in the height direction of the dishwasher 1, a second injection unit 42 disposed below the intermediate basket 52 in the height direction of the dishwasher 1, and a third injection unit 43 disposed above the upper basket 53 in the height direction of the dishwasher 1.

The first injection unit 41 may be rotatable about a rotating shaft 41*a*, the second injection unit 42 may be rotatable about a rotating shaft 42*a*, and the third injection unit 43 may be rotatable about a rotating shaft 43*a*.

However, the position of the injection unit is not limited to the first embodiment, and thus the first injection unit 41 may be fixed to one side of the lower surface 12*b* unlike the second injection unit 42 and the third injection unit 43. In this case, the first injection unit 41 may be configured to spray washing water in a substantially horizontal direction by a fixed nozzle, and the washing water sprayed in the horizontal direction from the nozzle of the first injection unit 41 may be directed to the upper side because a direction of the sprayed water is changed by a switching assembly. The switching assembly may be installed on a rail by a holder and translated along the rail.

The third injection unit 43 may spray the washing water toward the dishes stored in the upper basket 53 and the intermediate and lower baskets 52 and 51, and the second injection unit 42 may spray the washing water toward the dishes stored in the intermediate basket 52 and the upper basket 53.

Unlike the second injection unit 42 and the third injection unit 43, the first injection unit 41 may be arranged on the lower surface 12*b* of the tub 12. Particularly, the first injection unit 41 may be fixed to the sump 70.

The dishwasher 1 may include a circulation pump 30 configured to pump water stored in the sump 70 toward the injection units 41, 42, and 43. The washing water pumped by the circulation pump 30 may be supplied to the first injection unit 41 through an alternating device 80 connected to the circulation pump 30. Alternatively, the washing water pumped by the circulation pump 30 may be moved upward by a duct 90 and then supplied to the second injection unit 42 or the third injection unit 43.

As described above, the washing water stored in the sump 70 or washing water introduced into the dishwasher 1 from the outside may flow to the alternating device 80 by the circulation pump 30.

The alternating device 80 may provide the washing water to the first injection unit 41 through a connector 81 connected to the first injection unit 41, and may provide the washing water to the duct 90 through a flow path 62 connected to the duct 90.

The alternating device 80 may selectively provide the washing water to at least one of the connector 81 and the duct 90.

At least a part of the connector 81, and the flow path 62 may be arranged in a machine room L provided under the washing room C. That is, at least a part of the connector 400 and the flow path 62 may be disposed lower than the lower surface 12*b* of the tub 12 with respect to the height direction of the dishwasher 1. Through the connector 81 and the flow path 62, the washing water may flow to the first injection unit 41 and the duct 90 disposed inside the washing chamber C. The washing water may flow to the second injection unit 42 and the third injection unit 43 through the duct 90.

As illustrated in FIG. 3, the dishwasher 1 may include the machine room L disposed below the tub 12. The machine room L may be formed by a lower frame 300. The machine room L may include a lower surface portion 310 forming a base of the dishwasher, and a side surface portion 320 extending upwardly from the lower surface portion 310 and forming an interior space of the machine room L.

The side surface portion 320 may extend upward from an entire edge of the lower surface portion 310 to cover the entire side surface of the machine room L. Alternatively, as illustrated in FIG. 3, the side surface portion 320 may extend upward from at least a part of edge of the lower surface portion 310 to form at least a part of the side surface of the machine room L.

The above-described circulation pump 30, and sump 70, and alternating device 80 may be arranged in the machine room L and further a water supply hose 210 and a drain hose 100, which will be described later, may be arranged in the machine room L.

The dishwasher 1 may include the water supply hose 210 configured to supply washing water from the outside into the tub 12.

One end 211 of the water supply hose 210 may be connected to an air brake assembly 220 configured to communicate with the tub 12, and the other end (not shown) of the water supply hose 210 may be connected to the outside by penetrating the lower frame 300 (refer to FIG. 4).

The washing water may be moved from the other end (not shown) of the water supply hose 210 to the one end 211 and may be introduced into the tub 12 through the air brake assembly 220.

The air brake assembly 220 may be configured to communicate with a supply hole 12*e* formed on the side surface 12*d* of the tub 12 (refer to FIG. 1).

The air brake assembly 220 may supply the washing water into the tub 12 through the water supply hose 210.

The air brake assembly 220 may include an air hole 221. Through the air hole 221, external air may be introduced into the tub 12 or air in the tub 12 may be discharged to the outside.

The air brake assembly 220 may include a first hose fixing member 222 configured to fix at least a part of the water supply hose 210. In addition, as will be described later, the air brake assembly 220 may include a second hose fixing member 223 configured to fix at least a part of the drain hose 100.

The first hose fixing member 222 and the second hose fixing member 223 may be disposed to fix the water supply hose 210 and the drain hose 100 to the air brake assembly 220, respectively, without interference between the water supply hose 210 and the drain hose 100.

The dishwasher 1 may include the drain hose 100 configured to discharge the washing water remaining in the tub 12.

The drain hose 100 may be connected to the sump 70 to discharge the washing water stored inside the sump 70 to the outside of the dishwasher 1.

As described above, the washing water collected in the sump 70 may be purified by a filter in the sump 70 and then circulated back into the washing chamber C by the circulation pump 30.

However, when it is needed to discharge the washing water in the washing chamber C, the washing water collected in the washing chamber C and the sump 70 may be discharged to the outside of the washing chamber C through the drain hose 100.

The sump 70 may include a drain port (not shown) formed on one side of a water collector in which the washing water is collected.

The sump 70 may include a drain motor (not shown) configured pump the washing water to discharge the washing water collected in the sump 70 to the outside of the sump 70 through the drain port (not shown).

One end 111 of the drain hose 100 (corresponding to one end of the first drain hose 110 to be described later) may be connected to the drain port (not shown) of the sump 70 and the other end 132 of the drain hose 100 (corresponding to the other end of the second drain hose 130 to be described later) may be connected to the outside, thereby discharging washing water remaining in the tub 12 to the outside of the dishwasher 1.

That is, when a drainage operation starts, the drain motor (not shown) may be driven and the washing water collected in the sump 70 may be discharged to the drain port (not shown) and moved to the outside of the dishwasher 1 through the drain hose 100 connected to the drain port (not shown).

The drain hose 100 may include at least a section 100A of the drain hose 100. The at least a section 100A may be disposed at a position higher than the lower surface 12*b* of the tub 12 to prevent washing water from back-flowing from the outside or to prevent the washing water from moving in the inside of the drain hose 100 during other operation other than the drainage operation. The at least a section 100A may be practically disposed at a position higher than a washing water level inside the washing chamber C. However, because a height of the washing water level in the washing chamber C corresponds to an approximate height of the lower surface 12*b* of the tub 12, the lower surface 12*b* of the tub 12 may be set as a reference in which the at least a section 100A of the drain hose 100 is arranged.

Accordingly, the at least a section 100A of the drain hose 100 may be disposed to extend along the side surface 12*d* of the tub 12 from the machine room L.

A round section R may be formed on the at least a section 100A of the drain hose 100. As the drain hose 100 extends from the machine room L to the side surface 12*d* of the tub 12, the round section R may be naturally formed. The round section R may be disposed above the lower surface 12*b* of the tub 12.

The round section R may be formed with respect to the second hose fixing member 223. As described above, the round section R is a section formed in such a way that the drain hose 100 extends and naturally arranged.

With respect to a direction in which the other end 132 of the drain hose 100 extends from the one end 111 of the drain hose 100, the drain hose 100 may extend upward toward the second hose fixing member 223 and then be curved about an extension direction by the second hose fixing member 223 and extend downward.

Particularly, the round section R may be provided in such a way that one round section R is formed between the one end 111 of the drain hose 100 and the second hose fixing member 223, and one round section R is formed between the second hose fixing member 223 and the other end 132 of the drain hose 100, and thus total two round portions may be formed. However, the formation of the round section R is not limited thereto, and thus between the one end 111 and the other end 132 of the drain hose 100, a single round section R may be formed with respect to the second hose fixing member 223.

Alternatively, the at least a section 100A of the drain hose 100 may include two curved portions, which are perpendicular to each other, without the round section R. However, it is appropriate that the round section R is provided to allow the washing water in the drain hose 100 to smoothly flow.

In the conventional manner, at least three fixing members are used to include at least a portion of the drain hose that is disposed higher than the lower surface of the tub.

The conventional dishwasher includes a first fixing member configured to fix the top of the drain hose, which corresponds to the second hose fixing member 223 according to the first embodiment of the disclosure, and a second fixing member and a third fixing member configured to fix at least a part of the drain hose that extends from opposite sides of the first fixing member to the lower side.

Because practically, a component configured to support each fixing member is not provided in the machine room that is it may not easily support the fixing member because the lower frame 300 includes the lower surface portion 310 and the side surface portion 320 such as the lower frame 300 according to the disclosure, the fixing member fixes the drain hose by being coupled to the side surface of the tub.

At this time, as described above, at least three fixing members are required, and thus the working efficiency of fixing the drain hose is reduced and the number of required component may be increased due to the fixing member.

In addition, all the fixing members are disposed on the side surface of the tub and thus a fixing member, which is disposed on the lowermost side among the fixing members, is also disposed on the side surface of the tub. Accordingly, the drain hose is disposed higher than the lower surface of the tub, which is more than necessary, and thus the drain hose extends upward. Therefore, a length of the drain hose is increased more than necessary.

In addition, because the drain hose has a length longer than necessary, the drain hose and the water supply hose may interfere with each other on the side surface of the tub, and it may cause the damage.

According to the first embodiment of the disclosure, in order to relieve difficulty therein, the drain hose 100 may include a first coupling part 120 configured to be coupled to one side of the machine room L. Hereinafter the drain hose 100, and the first coupling part 120 of the drain hose 100 will be described in detail.

Figure 5:
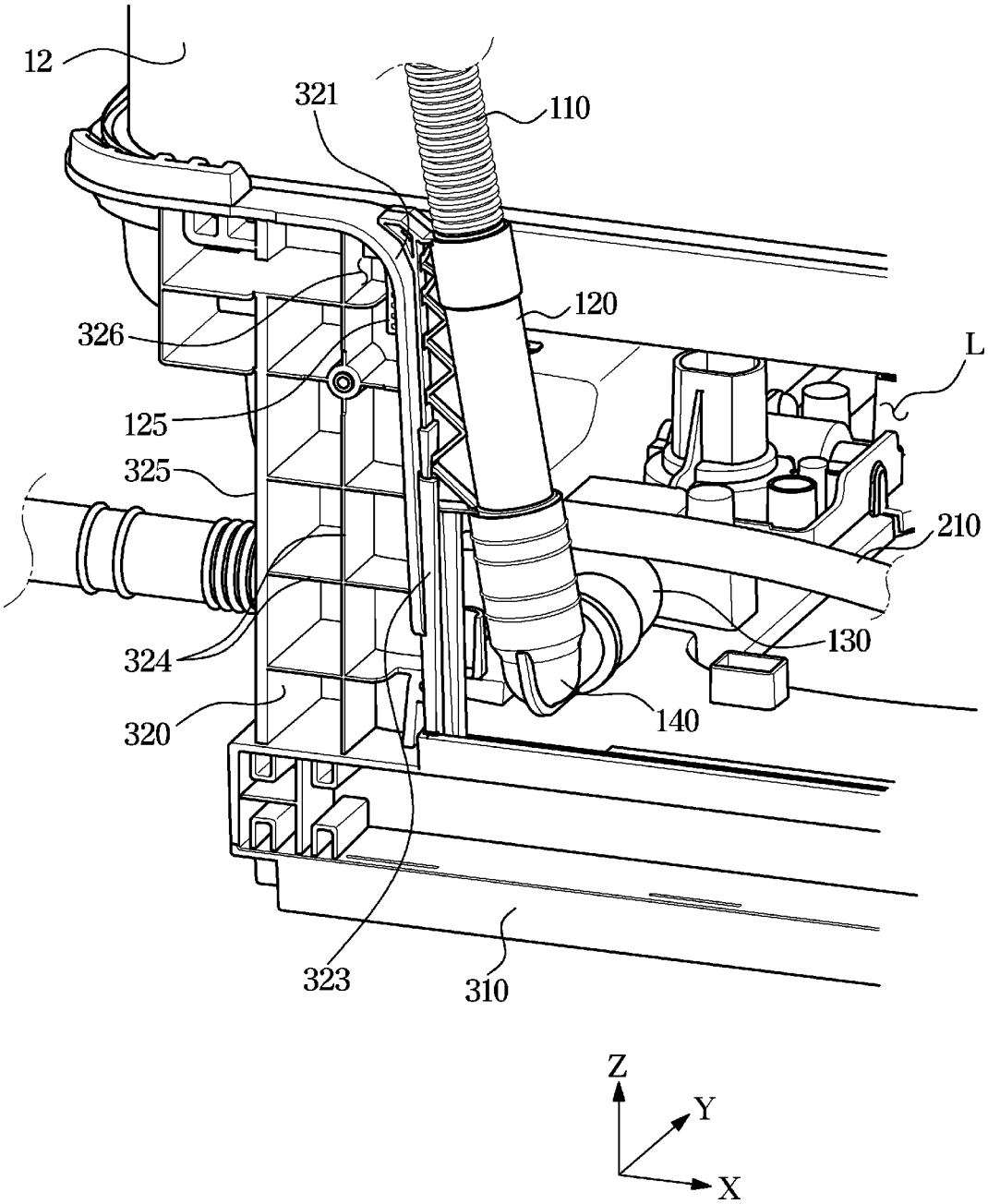
FIG. 5 is an enlarged perspective view of a part of FIG. 3.
Figure 6:
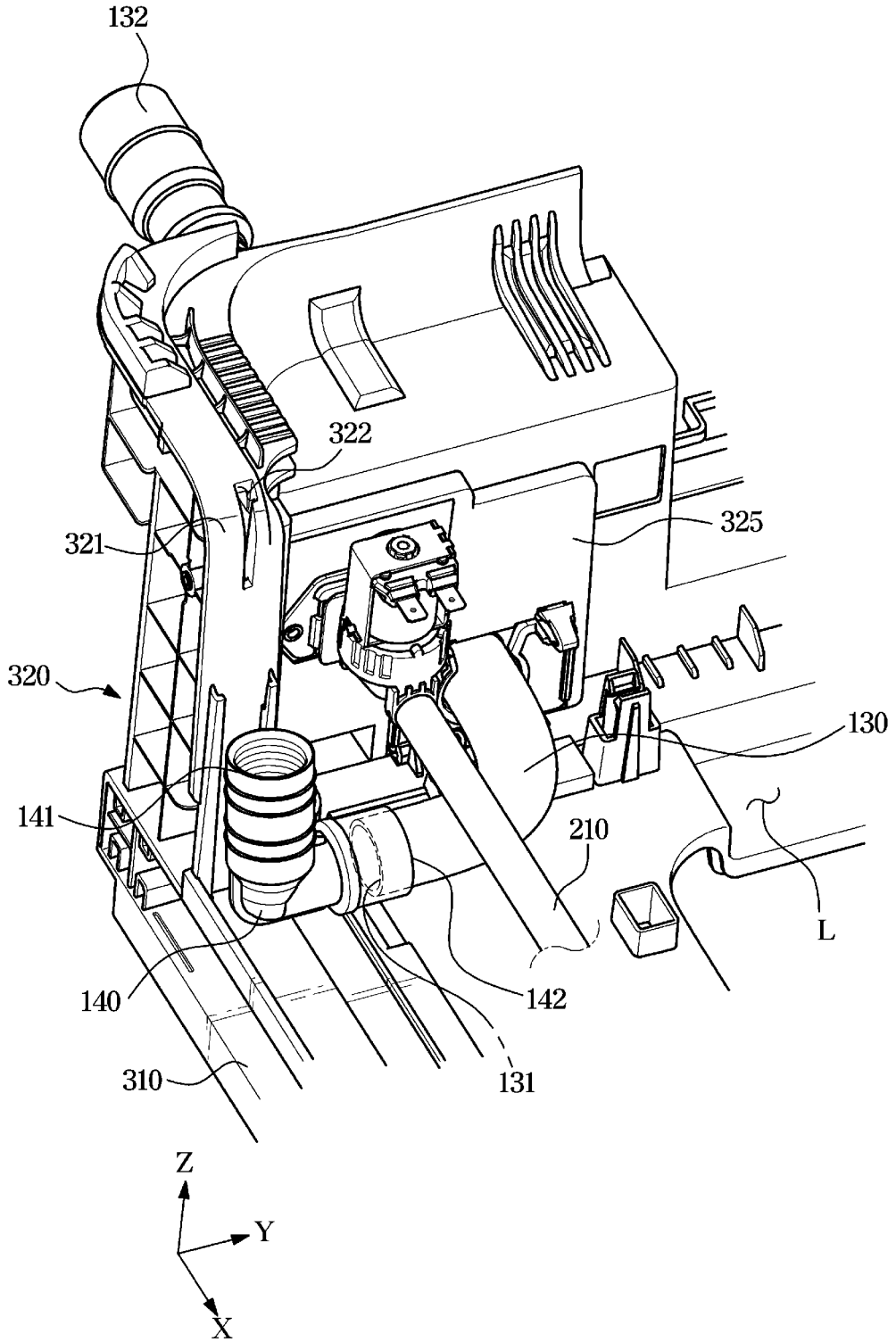
FIG. 6 is a longitudinal sectional view of some components of the dishwasher according to the first embodiment of the disclosure.

FIG. 4 is a side view of some components of the dishwasher according to the first embodiment of the disclosure, FIG. 5 is an enlarged perspective view of a part of FIG. 3, and FIG. 6 is a perspective view of some components of the dishwasher according to the first embodiment of the disclosure.

As illustrated in FIGS. 4 to 6, the drain hose 100 may include the first coupling part 120 provided on one side of the drain hose 100.

The drain hose 100 may include a first drain hose 110 including one end 111 connected to the sump 70 (refer to FIG. 3) and the other end 112 connected to the first coupling part 120.

The first coupling part 120 may be disposed in at least a portion of the drain hose 100, particularly, disposed at the one end of the first drain hose 110.

The first coupling part 120 may also correspond to one component of the first drain hose 110.

The drain hose 100 may include a second drain hose 130 including one end 131 connected to the other end portion 123 of the first coupling part 120 and the other end 132 connected to the outside.

The second drain hose 130 may include an intermediate part 140 connected to the other end portion 123 of the first coupling part 120. Particularly, the intermediate part 140 may be connected to the one end 131 of the second drain hose 130 and connected to the first coupling part 120.

The washing water stored in the sump 70 may be discharged to the outside of the dishwasher 1 through the first drain hose 110, the first coupling part 120 and the second drain hose 130.

The second drain hose 130 may be a component extending to the outside of the dishwasher 1, and thus the second drain hose 130 may be universally used in other devices such as a washing machine, dryer, and air conditioner as well as the dishwasher 1.

The first drain hose 110 may be provided in a corrugated pipe so as to be flexibly arranged in the dishwasher 1. As described later, this is because a section extending from the machine room L to the side surface 12*d* of the tub 12 is arranged in the first drain hose 110.

The other end 112 of the first drain hose 110 may be provided to be inserted into one end portion 122 of the first coupling part 120. The other end 112 of the first drain hose 110 and the section of the first drain hose 110 adjacent to the other end 112 may be covered by the one end portion 122 of the first coupling part 120.

Particularly, the first coupling part 120 may be provided to be inserted and injected into the first drain hose 110. Accordingly, the first drain hose 110 and the first coupling part 120 may be integrally formed with each other.

The first coupling part 120 may be configured to fix the drain hose 100 to one side of the machine room L. Particularly, the first coupling part 120 may be coupled to one side of the side surface portion 320 of the lower frame 300. Accordingly, the drain hose 100 may be supported by the side surface portion 320.

The first drain hose 110 may be fixed to the second hose fixing member 223. Particularly, a portion corresponding to the top of the first drain hose 110 may be fixed to the second hose fixing member 223.

The first drain hose 110 may include a second coupling part 113 configured to be fixed and coupled to the second hose fixing member 223.

The second hose fixing member 223 may be provided in a hook shape to which a tube is inserted. The second coupling part 113 may be provided as a region, in which corrugations are not formed, so as to be easily inserted into the second hose fixing member 223.

When a point coupled to the side surface portion 320 is defined as a first coupling point C1 and a point coupled to the second hose fixing member 223 is defined as a second coupling point C2 in the drain hose 100, the drain hose 100 according to the first embodiment of the disclosure may be supported inside the dishwasher 1 using only the first coupling point C1 and the second coupling point C2.

In the conventional manner, at least three coupling points formed in the drain hose are needed to couple the drain hose to the side surface of the tub. Therefore, at least three coupling components configured to couple the drain hose to the side surface of the tub are needed at three coupling points.

However, according to an embodiment of the disclosure, because the drain hose 100 includes the first coupling part 120, an additional coupling point coupled to the side surface

12*d* of the tub 12 may not be needed other than the second coupling point C2 coupled to the second hose fixing member 233.

Therefore, an additional component for coupling the drain hose 100 to the side surface 12*d* of the tub 12 is not needed, and thus it is possible to simplify the coupling structure of the drain hose 100. The first coupling part 120 may be coupled to one side of the machine room L in the vertical direction corresponding to the up and down direction Z, and the second coupling part 113 may be coupled to the tub 12 in horizontal direction corresponding to the front and rear direction X.

As described above, the drain hose 100 may include the first coupling point C1 and the second coupling point C2, and the first coupling point C1 and the second coupling point C2 may be arranged in different directions. Particularly, it is appropriate that the first coupling point C1 and the second coupling point C2 may be coupled to the side surface portion 320 and the side surface 12*d* of the tub 12 in directions perpendicular to each other.

In addition, when a section of the drain hose 100 forming a flow path, on which the washing water flows, is defined as a hose body 101, a part of the hose body 101 arranged in the first coupling part 120 may be longer than a part of the hose body 101 arranged in the second coupling part 113.

The hose body 101 may be formed on the first drain hose 110, the second drain hose 130 and the first coupling part 120, respectively.

Therefore, a part of the hose body 101 coupled in the up and down direction may be longer than a part of the hose 101 coupled in the horizontal direction.

By using only the second coupling point C2 coupled to the tub 12 through the first coupling part 120, the drain hose 100 may be arranged to easily form the at least a section 100A (hereinafter referred to as the upper portion 100A) of the drain hose 100 formed at a higher position than the lower surface 12*b* of the tub 12 (a water level B when the dishwasher 1 is driven in FIG. 4).

Even when a point, in which the drain hose 100 is coupled to the inside of the dishwasher 1, is lower than the conventional point and a height H of the second coupling part 113 positioned on the top of the drain hose 100 based on the water level B of the inside of the dishwasher 1 is relatively low, it is possible to easily form the round section R provided in the upper portion 100A. That is, as the fixed point is formed to be low, a point, in which a curve starts from the lower side in the upper portion 100A, is formed on a position lower than the conventional point.

Therefore, the drain hose 100 may have a smaller number of coupling points C1 and C2 than the conventional manner, and the length of the drain hose 100 mounted inside the dishwasher 1 may be shortened. The upper portion 100A may be formed on the first drain hose 110. As described above, as the first coupling part 120 is coupled to the side surface portion 320 of the lower frame 300, the upper portion 100A may be formed between the first coupling part 120 and the one end 111 of the first drain hose 110.

As described above, because the first drain hose 110 is formed in a corrugated shape, the round section R may be easily formed on the upper portion 100A.

The intermediate part 140 may be connected to the other end portion 123 of the first coupling part 120. Particularly, the other end portion 123 of the first coupling part 120 may be inserted into one end 141 of the intermediate part 140.

The intermediate part 140 is served as a component of the second drain hose 130 and a component configured to connect the first coupling part 120 to the second drain hose 130. The other end 142 of the intermediate part 140 may be connected to the one end 131 of the second drain hose 130.

However, the disclosure is not limited thereto, and the intermediate part 140 may be a separate component of the drain hose 100, which is different from the second drain hose 130.

The intermediate part 140 may be formed of a material that is softer than the first coupling part 120. Accordingly, the other end portion 123 of the first coupling part 120 may be easily inserted into the intermediate part 140. That is, when the first coupling part 120 is formed of a plastic injection material, the intermediate part 140 may be formed of a rubber material.

The intermediate part 140 may be formed such that the one end 141 and the other end 142 of the intermediate part 140 are opened in directions perpendicular to each other. That is, by including the curved shape, the intermediate part 140 may be provided such that the one end 141 and the other end 142 are directed in directions perpendicular to each other.

Particularly, when the one end 141 of the intermediate part 140 is disposed in the up and down direction Z, the other end 142 of the intermediate part 140 may be disposed in the front and rear direction X or the left and right direction Y. This is to prevent the bending stress in the up and down direction Z from being transmitted to the first coupling part 120. This will be described later in detail.

Accordingly, the other end 112 of the first drain hose 110 and the one end 131 of the second drain hose 130 may be arranged in directions perpendicular to each other.

The one end 131 of the second drain hose 130 may be connected to the other end 142 of the intermediate part 140 as described above. The other end 132 of the second drain hose 130 may be disposed outside by passing through a through surface 325 of the side surface portion 320. Further, the water supply hose 210 may be connected to the outside through the through surface 325.

The washing water stored in the dishwasher 1 may be discharged through the other end 132 of the second drain hose 130.

The first coupling part 120 may be coupled to the side surface portion 320 in the up and down direction Z. As described later, the first coupling part 120 may include an insertion portion 125 inserted into a slit 322 that is vertically opened in the side surface portion 320. The first coupling part 120 and the side surface portion 320 may be coupled to each other when the insertion portion 125 is vertically inserted into the slit 322.

The first coupling part 120 may be coupled to the side surface portion 320 in the up and down direction Z, thereby stably supporting the drain hose 100.

In other words, the first coupling part 120 may be coupled to the side surface portion 320 in the direction in which the drain hose 100 extends. At the first coupling point C1, the drain hose 100 may be arranged to extend in the approximate up and down direction, and at the first coupling point C1, the first coupling portion 120 may be inserted and coupled to the side surface portion 320 along the extension direction of the drain hose 100.

Therefore, the first coupling part 120 may be coupled to the side surface portion 320 in the direction in which the drain hose 100 extends, thereby stably supporting the drain hose 100.

However, the disclosure is not limited thereto, and thus the first coupling part 120 may be coupled to a component of the lower frame 300 in the approximate up and down direction, other than the side surface portion 320. Alternatively, the first coupling part 120 may be coupled to an additional member forming one side of the machine room L in the approximate up and down direction, other than the lower frame 300.

Alternatively, the first coupling part 120 may be coupled to the lower frame 300 in an approximate front and rear direction X or left and right direction Y. However, even in this case, at the first coupling point C1, the first coupling part 120 may be coupled to the lower frame 300 in the same direction as the direction in which the drain hose 100 extends.

That is, when the drain hose 100 extends in the front and rear direction X at the first coupling point C1, the first coupling part 120 may be coupled to the lower frame 300 in the front and rear direction X, and when the drain hose 100 extends in the left and right direction Y at the first coupling point C1, the first coupling part 120 may be coupled to the lower frame 300 in the left and right direction Y.

As described above, by the first coupling part 120, it is possible to reduce the length of the drain hose 100 disposed within the dishwasher 1. Particularly, the length of the first drain hose 110 connecting the one end portion 122 of the first coupling part 120 to the sump 70 may be reduced.

When a height of an upper end of the second coupling part 113 positioned on the top of the drain hose 100 based on the water level B of the inside of the dishwasher 1 is defined as an upper height H, the upper height H may be lower than a height of an upper portion of the drain hose of the conventional dishwasher. This is because the first coupling point C1 is arranged to be low, as described above.

Accordingly, the second hose fixing member 223 configured to fix the second coupling part 113 may be disposed at a lower end of the air brake assembly 220. According to the conventional manner, the upper height of the drain hose of the dishwasher is formed to be higher than the approximate height at which the air brake assembly is disposed, and the top of the drain hose is fixed to a position higher than the air brake assembly.

However, the upper height H according to the first embodiment of the disclosure may be formed to correspond to the lower end of the air brake assembly 220. Therefore, the second hose fixing member 223 may correspond to a part of the air brake assembly 200 and thus disposed in the lower side of the air brake assembly 220.

Accordingly, according to the disclosure, the second hose fixing member 223 may be formed as one component of the air brake assembly 220, and thus may be integrally molded with the air brake assembly 220 through a method such as injection.

Therefore, it is not needed that the second hose fixing member 223 is additionally fixed to the side surface 12*d* of the tub 12.

In addition, because the upper height H is formed to correspond to the lower end of the air brake assembly 220, the water supply hose 210 coupled to the upper side of the air brake assembly 220 may be not interfered with the drain hose 100 in the up and down direction on the side surface 12*d* of the tub 12 and thus it is possible to improve reliability.

As illustrated in FIG. 4, a vertical section 100V of the drain hose 100, which extends in the up and down direction in the drain hose 100, may be arranged closer than a vertical section 210V of the water supply hose 210, which extends in the up and down direction in the water supply hose 210, with respect to the through surface 325.

The above mentioned vertical section 100V of the drain hose 100 may represent a section that is spaced apart from the second coupling point C2 with respect to the through surface 325 and extends in the up and down direction. Alternatively, a vertical section disposed closer than the second coupling point C2 and extending in the up and down direction to be coupled to the first coupling part 120 may correspond to the vertical section 100V. That is, a length L1 between the vertical section 100V of the drain hose 100 and the through surface 325 may be less than a length L2 between the vertical section 210V of the water supply hose 210 and the through surface 325.

As described above, as the length of the first drain hose 110 disposed inside the dishwasher 1 is reduced by the first coupling part 120, the length L1 between the vertical section 100V of the drain hose 100 and the through surface 325 may be reduced.

Accordingly, the drain hose 100 and the water supply hose 210 may be disposed on the side surface 12*d* of the tub 12 without the interference in the front and rear direction X, and thus it is possible to improve reliability of the dishwasher 1.

That is, because the drain hose 100 and the water supply hose 210 are disposed on the side surface 12*d* of the tub 12 without overlapping, it is possible to prevent damage and noise caused by collision between the drain hose 100 and the water supply hose 210.

Although not shown in the drawing, an insulating member formed of a felt material may be disposed between the side surface 12*d* of the tub 12 and the side surface of the main body 10. Particularly, on the side surface 12*d* of the tub 12, the drain hose 100 may disposed more inner side than the water supply hose 210, and thus the insulating member may be efficiently arranged on the side surface 12*d* of the tub 12.

That is, the drain hose 100 and the water supply hose 210 may be arranged without the intersection or the interference. Particularly, the drain hose 100 may be arranged in a relatively narrow range on the side 12*d* of the tub 12 and thus the insulting member may be arranged in a relatively wider range.

Therefore, due to the efficient arrangement of the drain hose 100, the insulation efficiency between the washing room C and the outside of the dishwasher 1 may be increased.

Hereinafter the features of the first coupling part 120 and the technical features in which the first coupling part 120 is coupled to the side surface portion 320 will be described in detail.

Figure 7:
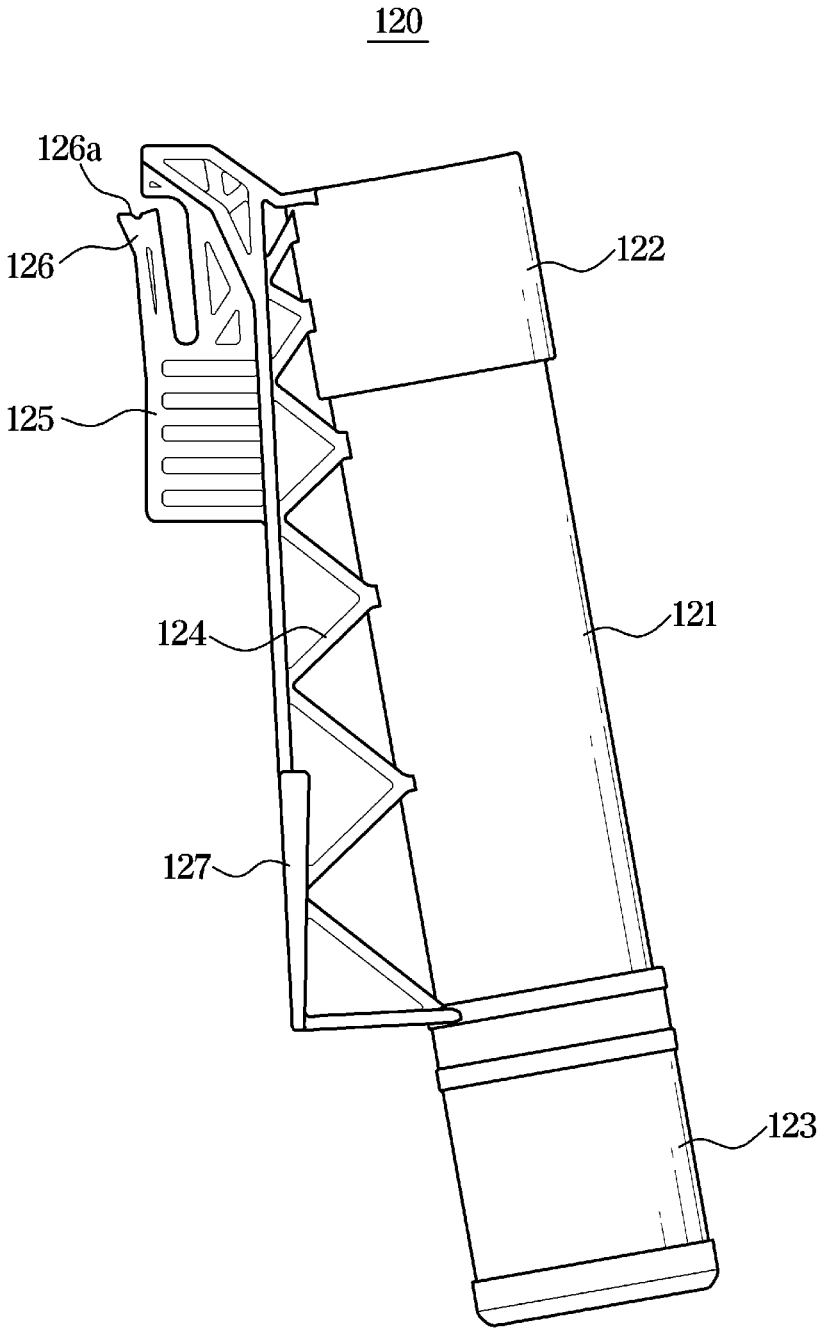
FIG. 7 is a perspective view of a coupling member of the dishwasher according to the first embodiment of the disclosure.
Figure 8:
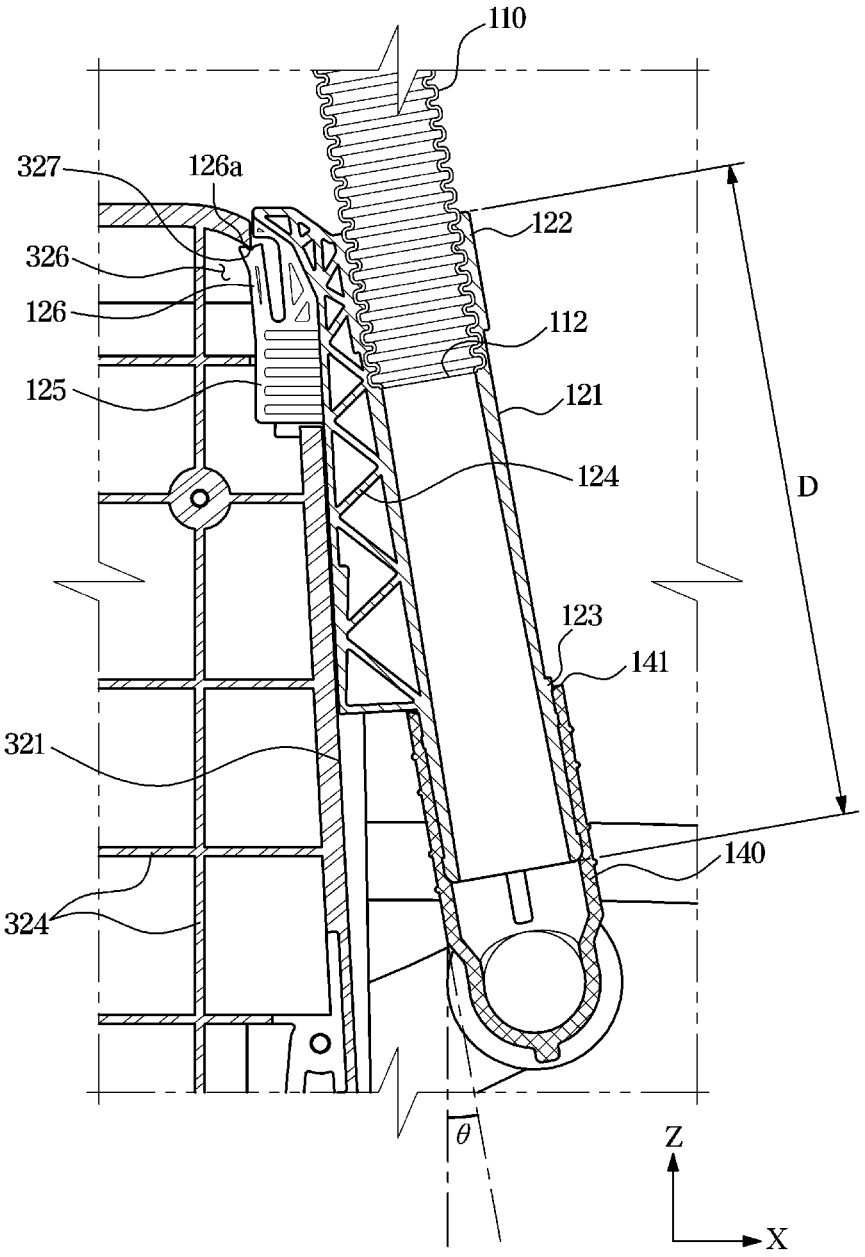
FIG. 8 is a longitudinal sectional view of some components of the dishwasher according to the first embodiment of the disclosure.
Figure 9:
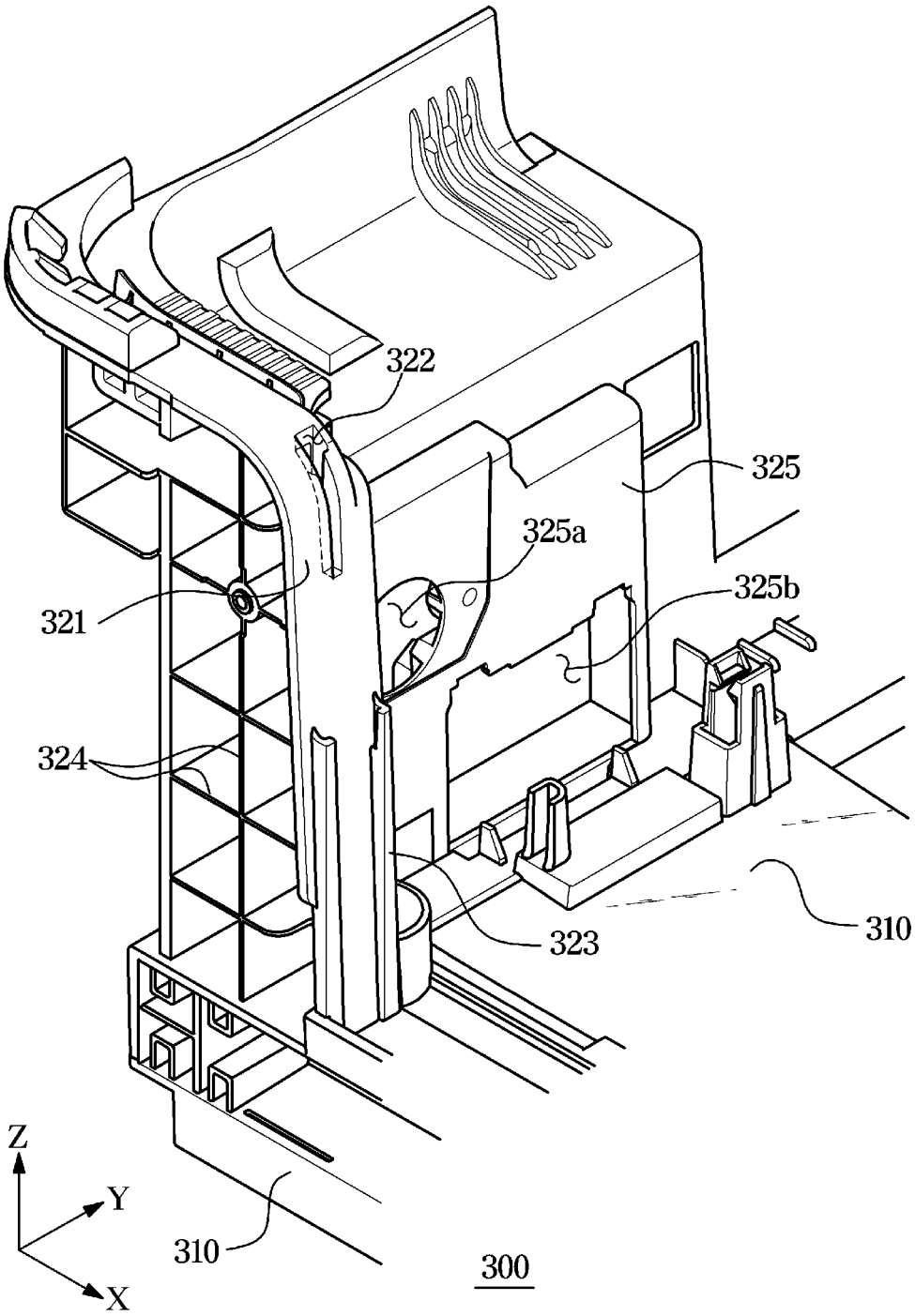
FIG. 9 is a perspective view of a lower frame of the dishwasher according to the first embodiment of the disclosure.
Figure 10:
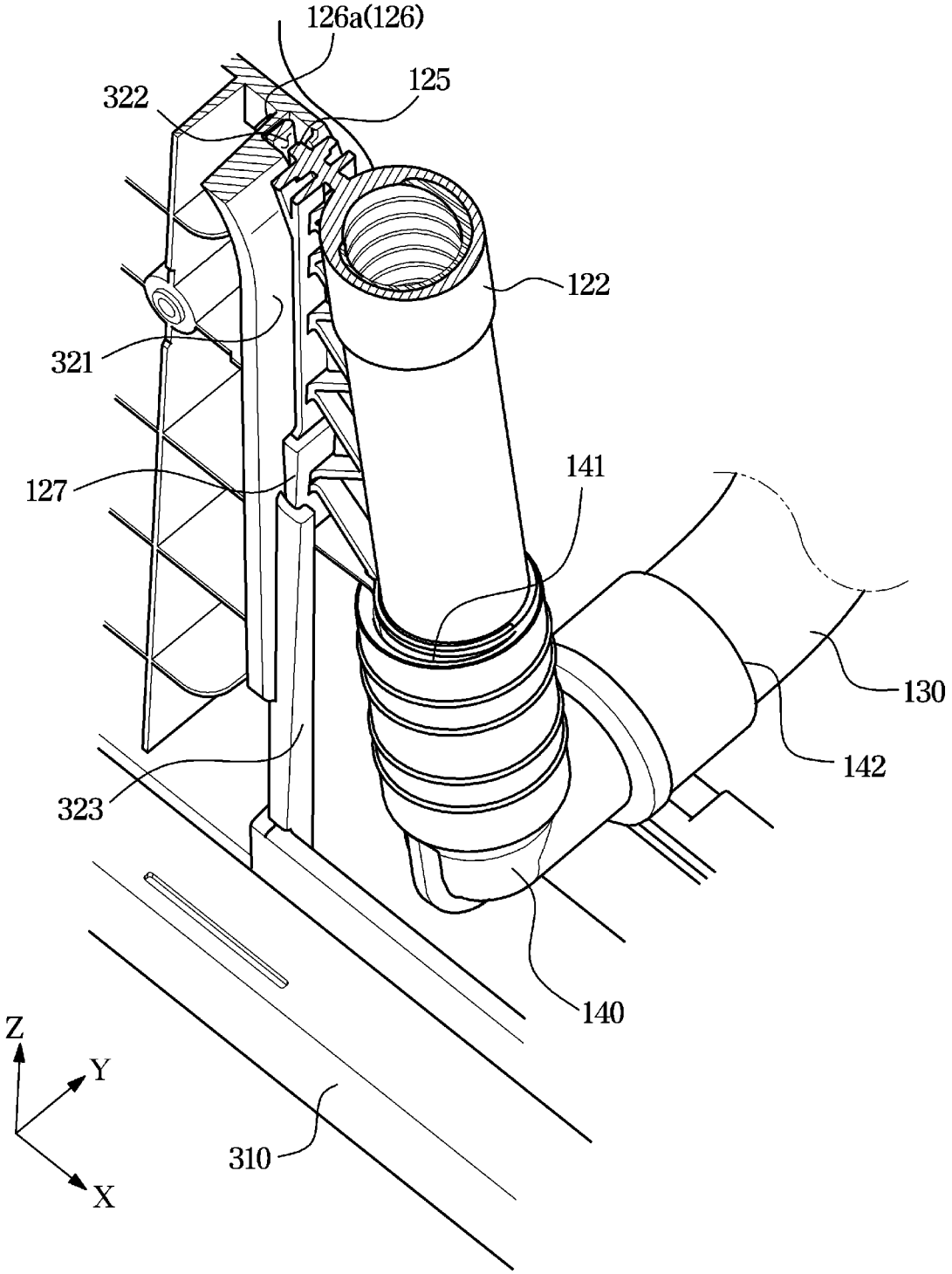
FIG. 10 is a cross sectional view of some components of the dishwasher according to the first embodiment of the disclosure.

FIG. 7 is a perspective view of a coupling member of the dishwasher according to the first embodiment of the disclosure, FIG. 8 is a longitudinal sectional view of some components of the dishwasher according to the first embodiment of the disclosure, FIG. 9 is a perspective view of a lower frame of the dishwasher according to the first embodiment of the disclosure, and FIG. 10 is a cross sectional view of some components of the dishwasher according to the first embodiment of the disclosure.

As illustrated in FIGS. 7 to 10, the first coupling part 120 may include a body 121 extending in a tubular shape, the one end portion 122 and the other end portion 123. The one end portion 122 may be arranged in the upper side and the other end portion 123 may be arranged in the lower side when the first coupling part 120 is coupled to the side surface portion 320.

The one end portion 122 and the other end portion 123 may be formed in the tubular shape extending in the up and down direction in the body 121.

An inner circumferential surface of the one end portion 122 may be formed to allow the one end 112 and a vicinity of the one end 112 of the first drain hose 110 to be inserted thereto. That is, an outer circumferential surface of the one end 112 of the first drain hose 110 and the vicinity of the first drain hose 110 may be covered by the one end portion 122.

As described above, the first coupling part 120 may be provided to be inserted and injected into the first drain hose 110. Accordingly, the one end portion 122 and the first drain hose 110 may be integrally formed with each other.

The other end portion 123 may be provided to be inserted into the one end 141 of the intermediate part 140. However, the disclosure is not limited thereto, and the one end 141 of the intermediate part 140 may be provided to be inserted into the other end portion 123. At this time, the intermediate part 140 may be provided to have a greater strength than the strength of the first coupling part 120.

The first coupling part 120 may be formed to have a predetermined distance D in the extending direction of the body 121. Because the first coupling part 120 is formed to have the predetermined distance D, the support force of the drain hose 100 may be increased by the first coupling part 120. This will be described later in detail.

The first coupling part 120 may include the insertion portion 125 inserted into the side surface portion 320. The insertion portion 125 may be disposed outside the body 121 and extend in a direction in which the body 121 extends.

The insertion portion 125 may be provided to be inserted to the slit 322 of the side surface portion 320 to be described later in the approximate up and down direction.

The side surface portion 320 may include a seating surface 321 provided on one side of the side surface portion 320 and on which the first coupling part 120 is seated. The first coupling part 120 may slide with respect to the side surface portion 320 through the seating surface 321 and thus the insertion portion 125 may be easily inserted into the slit 322.

The seating surface 321 may be provided to extend in the approximate up and down direction and, unlike FIG. 9, the seating surface 321 may extend in a direction perpendicular to the lower surface portion 310.

The side surface portion 320 may include the slit 322 cut out in the up and down direction on the seating surface 321. As described above, the slit 322 is a cut-out portion to which the insertion portion 125 is vertically inserted.

The side surface portion 320 may include a rib body 324 extending upward from the lower surface portion 310. The rib body 324 may be formed in such a way that lattice ribs are continuously formed, thereby securing strength against external force transmitted to the side surface portion 320 in the up and down direction Z or the front and rear direction X.

The above mentioned through surface 325 may be disposed on one side of the side surface portion 320. The through surface 325 may include a water supply through hole 325*a* provided to allow the water supply hose 210 to be transmitted to the outside, and a drain through hole 325*b* provided to allow the second drain hose 130 to be transmitted to the outside.

The seating surface 321 may be disposed on the edge of the rib body 324. This is to couple the first coupling part 120 to a region of the side surface portion 320 having high strength.

The side surface portion 320 may include a guide rail 323 disposed on the seating surface 321 and configured to guide the first coupling part 120 to allow the insertion portion 125 to be inserted into the slit 322.

The first coupling part 120 may include a guide portion 127. The guide portion 127 is disposed below the insertion portion 125 and when the guide portion 127 is vertically moved on the seating surface 321, the guide portion 127 is inserted to the guide rail 323 and slides.

When the guide portion 127 is inserted into the guide rail 323 and vertically slides, the insertion portion 125 may be vertically inserted to the slit 322.

The guide rail 323 may constrain the guide portion 127 in the front and rear direction X and the left and right direction Y, and thus when the first coupling part 120 is coupled to the side surface portion 320, the guide rail 323 may additionally improve the coupling force in the front and rear direction X and the left and right direction Y.

The first coupling part 120 may include a support hook 126 provided in the upper side of the insertion portion 125 and inserted into the slit 322 together with the insertion portion 125 and then hooked to an inner support 327 of the slit 322 after the insertion of the insertion portion 125.

The support hook 126 may be formed to be separated from the upper portion of the insertion portion 125 by a predetermined distance. The support hook 126 may be provided to have a predetermined elasticity in the front and rear direction X with respect to the upper portion of the insertion portion 125.

With respect to the front and rear direction X, a distance between the support hook 126 and opposite ends of the upper portion of the insertion portion 125 may be greater than a width of the slit 322 in the front and rear direction X. Accordingly, when the insertion portion 125 is inserted into the slit 322, the support hook 126 may be pressed against the slit 322 in the front and rear direction X, and the distance between the support hook 126 and opposite ends of the upper portion of the insertion portion 125 in the front and rear direction X may become less than or equal to the width of the slit 322 in the front and rear direction X. Therefore, the insertion portion 125 and the support hook 126 may penetrate the slit 322.

When the insertion portion 125 penetrates the slit 322 and is completely inserted into the side surface portion 320, the support hook 126 may also penetrate the slit 322, and by the elastic force, the distance between the support hook 126 and opposite ends of the upper portion of the insertion portion 125 in the front and rear direction X may return to a previous state that is longer than the width of the slit 322 in the front and rear direction X.

Accordingly, the support hook 126 may be hooked to the inner support 327. The inner support 327 is formed on the opposite side of the seating surface 321 and positioned on the outside of the slit 322 with respect to the front and rear direction X.

Particularly, the support hook 126 may include a support groove 126*a* formed in the upper side of the support hook 126 and formed in a groove shape. The support groove 126*a* may be in contact with the inner support 327 when the inner support 327 is hooked to the support hook 126. Accordingly, the support hook 126 may be constrained to the inner support 327 in the up and down direction Z, thereby preventing the first coupling part 120 from being detached from the side surface portion 320.

Further, because the support hook 126 is hooked to the inner support 127 in a state in which the insertion portion 125 is inserted into the side surface portion 320, the insertion portion 125 may be prevented from moving in the front and rear direction X or left and right direction Y, thereby preventing the first coupling part 120 from being detached from the side surface portion 320.

In addition, as described above, the guide portion 127 may be constrained to the guide rail 323 in the front and rear direction X or left and right direction Y, thereby additionally preventing the first coupling part 120 from being detached from the side surface portion 320.

The first coupling part 120 may include a rib portion 124 configured to connect the insertion portion 125 and the guide portion 127 to the body 121. The rib portion 124 may be provided with a plurality of ribs provided in a zigzag shape, and thus even when the external force transmitted to the body 121 is transmitted to the insertion portion 125 or the guide portion 127, the rib portion 124 may maintain strength thereof.

The rib portion 124 may be provided to allow the body 121 to be inclined at a predetermined angle θ with respect to the up and down direction Z based on coupling between the first coupling part 120 and the side surface portion 320.

Because the body 121 is inclined at the predetermined angle θ with respect to the up and down direction Z, it is possible to additionally secure a space in which the first drain hose 110 and the second drain hose 130 are bent.

It is appropriate that the predetermined angle θ is formed from 0 to 45 degrees.

Therefore, a curvature of the curved surface of the first drain hose 110 and the second drain hose 130 may be increased, and thus resistance of the washing water flowing in the first drain hose 110 and the second drain hose 130 may be reduced.

The first coupling part 120 may be easily separated from the side surface portion 320 as needed.

As illustrated in FIG. 8, the insertion portion 125 and the support hook 126 passing through the slit 322 may be disposed in a space 326 formed between the lattice ribs of the rib body 324.

When a user intends to separate the first coupling part 120 coupled to the side surface portion 320, the user may insert a finger or the like into the space 326 formed between the lattice ribs of the rib body 324, and press the support hook 126 in the front and rear direction X. When pressing the support hook 126 in the front and rear direction X, the distance between the support hook 126 and opposite ends of the upper portion of the insertion portion 125 in the front and rear direction X may become less than or equal to the width of the slit 322 in the front and rear direction X. Therefore, the constraint of the first coupling part 120 in the up and down direction Z may be released.

When the user presses the first coupling part 120 upward, the constraint of the first coupling part 120 in the up and down direction Z may be released and thus the user may easily separate the first coupling part 120 in the up and down direction.

As mentioned above, because the side surface portion 320 and the first coupling part 120 are easily coupled to each other or separated from each other while sliding in the up and down direction, the assembly of the drain hose 100 may be improved.

In addition, because the first coupling part 120 is coupled to the side surface portion 320 in the up and down direction as described above, the first coupling part 120 may maintain high strength without separation even when external force is transmitted to the first coupling part 120 in the front and rear direction X or the left and right direction Y.

Most of the external force transmitted to the first coupling part 120 may be transmitted through the second drain hose 130. When the user moves the dishwasher 1 or installs the dishwasher 1, particularly the user connects the second drain hose 130 to the outside, a tensile force may generated in the second drain hose 130 and thus the bending stress may be transmitted to the first coupling part 120.

As described above, when the one end 141 of the intermediate part 140 is disposed in the up and down direction Z, the other end 142 of the intermediate part 140 may be arranged in the front and rear direction X or left and right direction Y. Therefore, the bending stress generated by the second drain hose 130 may be formed in the front and rear direction X or left and right direction Y and the bending stress may not be transmitted in the up and down direction Z, and thus the first coupling part 120 may maintain the coupling force without separation caused by the external force.

The first coupling part 120 may extend to have the predetermined distance D as described above, and thus the first coupling part 120 may secure the strength against the bending stress generated by the second drain hose 130.

The other end portion 123 may be disposed at any one position in the up and down direction Z according to the predetermined distance D of the first coupling part 120.

When the other end portion 123 is disposed at any one position with respect to the up and down direction Z, the intermediate part 140 or the second drain hose 130 connected to the other end portion 123 may be pulled upward from the lower surface portion 310 to be positioned on a height in which the other end portion 123 is arranged.

That is, the bending stress transmitted to the first coupling part 120 may be changed according to the height at which the other end portion 123 is disposed, and thus, by adjusting the predetermined distance D of the first coupling part 120, it is possible to easily set the bending stress transmitted to the first coupling part 120.

On the other hand, according to the predetermined distance D value of the first coupling part 120, the one end portion 122 may be disposed at any one position in the up and down direction Z.

A curvature of the round section R may be changed based on the position on which the one end portion 122 is disposed with respect to the up and down direction Z, and thus it is possible to easily set the curvature of the round section R by adjusting the predetermined distance D of the first coupling part 120. Hereinafter a first coupling part 170 of a dishwasher 1 according to a second embodiment of the disclosure will be described. Other than components of the first coupling part 170 described below, components of the dishwasher 1 are the same as the dishwasher 1 according to the first embodiment of the disclosure, and thus a description thereof will be omitted.

Figure 11:
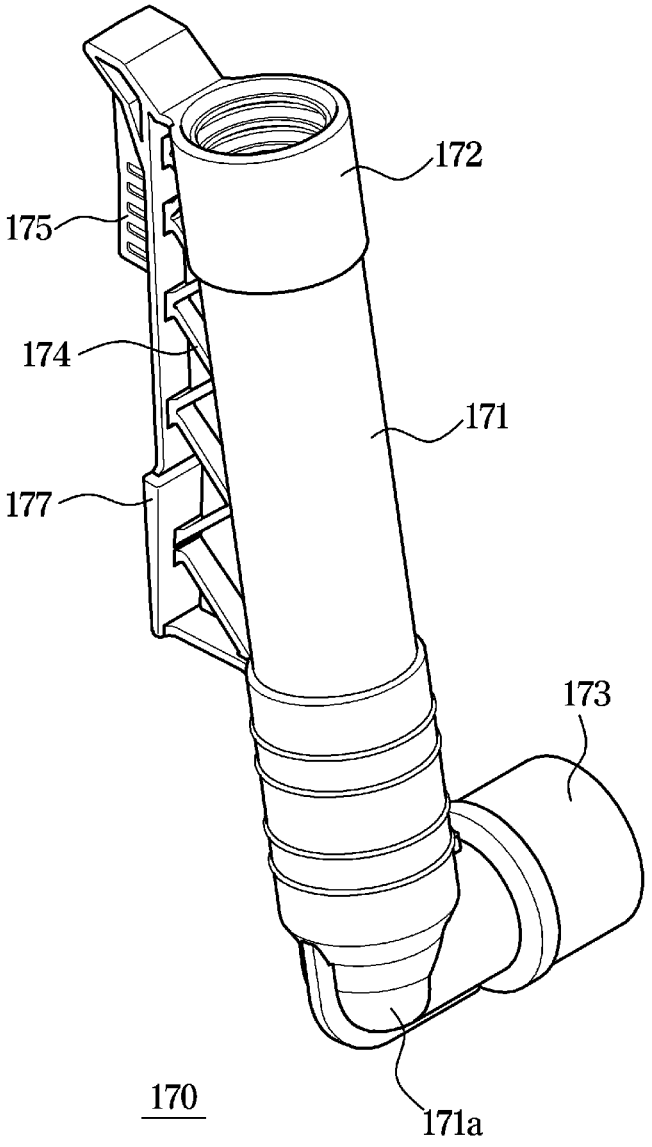
FIG. 11 is a perspective view of a coupling member of a dishwasher according to a second embodiment of the disclosure.

FIG. 11 is a perspective view of a coupling member of a dishwasher according to a second embodiment of the disclosure.

As illustrated in FIG. 11, the first coupling part 170 may include a body 171 in a tubular shape, one end portion 172 disposed in the upper side of the body 171, and other end portion 173 disposed in the lower side of the body 171.

At least a part of the body 171 may extend in a direction corresponding to the approximate up and down direction Z, and the body 171 may include a body curved portion **171*a* formed in such a way that other portion of the body 171** is perpendicular to the front and rear direction X or left and right direction Y with respect to the up and down direction Z.

Accordingly, the one end portion 172 and the other end portion 173 may be disposed to face the directions perpendicular to each other. That is, the one end portion 172 may be directed to the up and down direction Z, and the other end portion 173 may be directed to the front and rear direction X or left and right direction Y.

The other end portion 173 may be disposed to face the direction perpendicular to the direction in which an insertion portion 175 or a guide portion 177 extends.

According to the first embodiment of the disclosure, the other end portion 123 of the first coupling part 120 is coupled to the intermediate part 140 that is arranged to allow the one end 141 and the other end 142 to be perpendicular to each other. However, according to another embodiment of the disclosure, the first coupling part 170 may not include the intermediate part 140.

That is, according to the first embodiment of the disclosure, the intermediate part 140 corresponding to a component of the second drain hose 130 may be provided in such a way that a portion curved in the left and right direction Y is arranged on the second drain hose 130, but according to the second embodiment of the disclosure, a portion curved in the left and right direction Y may be arranged on the first coupling part 170.

Therefore, the other end portion 173 may be directly coupled to the one end of the second drain hose 130 in which the intermediate part 140 is not provided.

Hereinafter a drain hose 100' of a dishwasher 1 according to a third embodiment of the disclosure will be described. Other than components of the drain hose 100' described below, components of the dishwasher 1 are the same as the dishwasher 1 according to the first embodiment of the disclosure, and thus a description thereof will be omitted.

Figure 12:
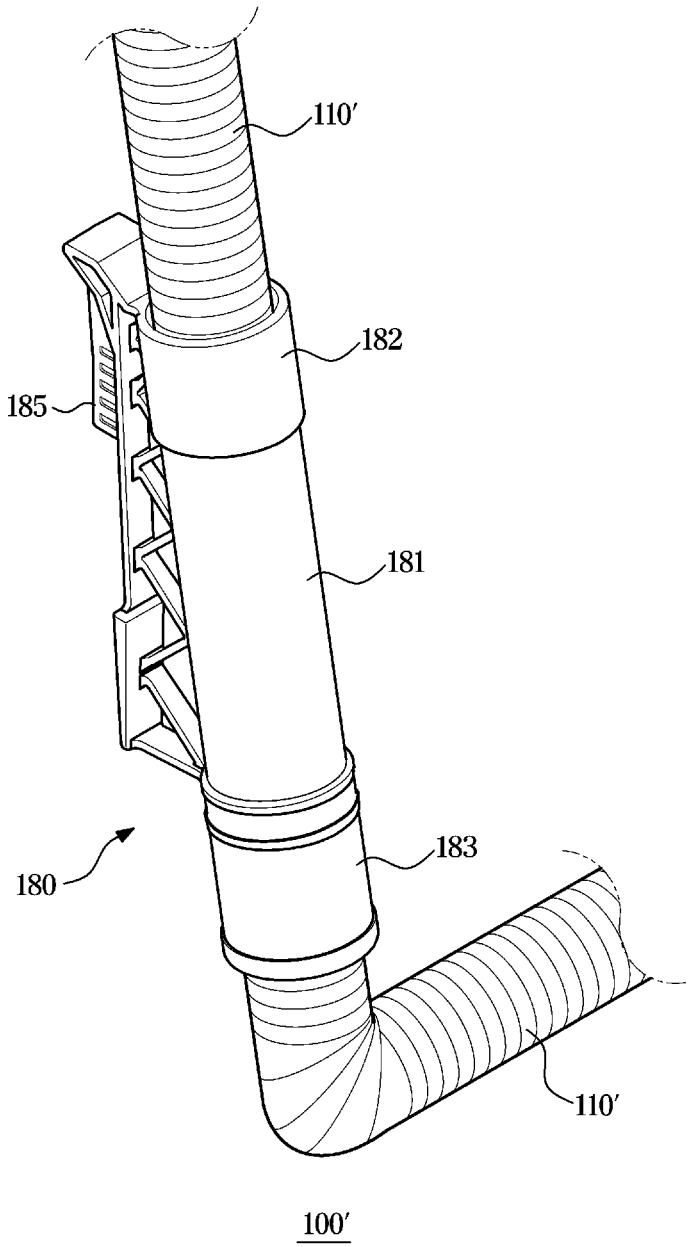
FIG. 12 is a perspective view of a drain hose and a coupling member of a dishwasher according to a third embodiment of the disclosure.
Figure 13:
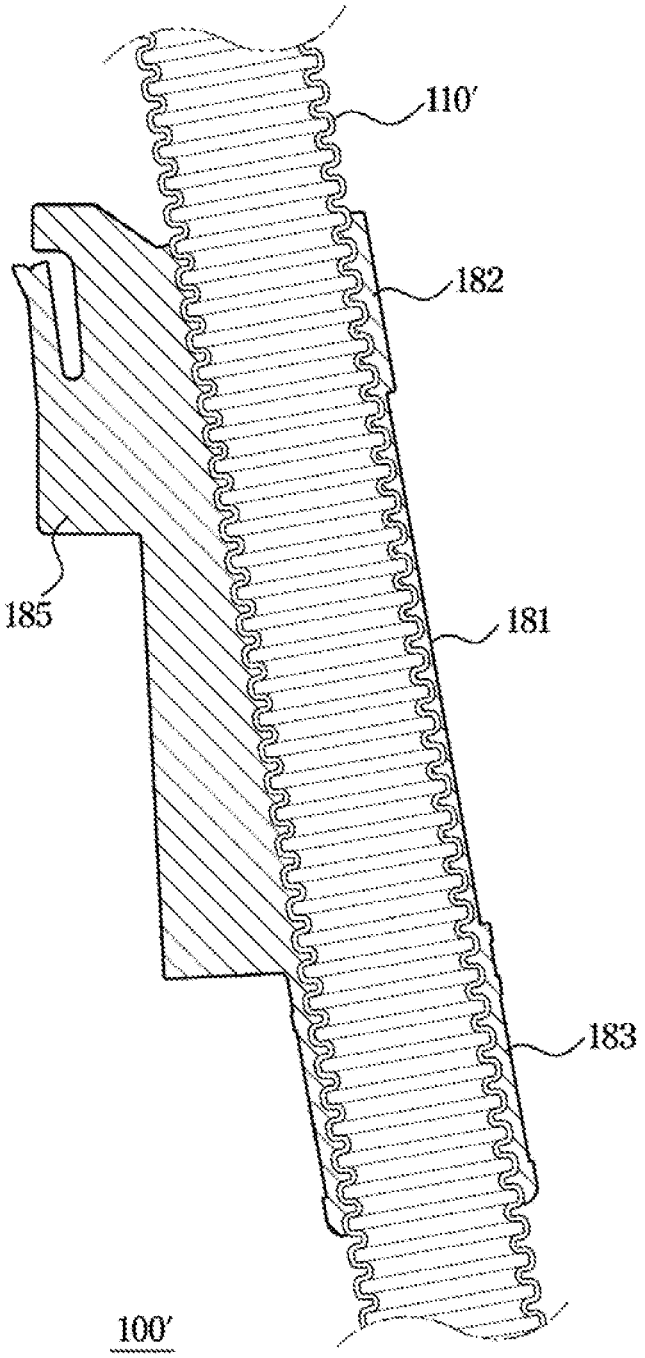
FIG. 13 is a cross sectional view of the drain hose and the coupling member of the dishwasher according to the third embodiment of the disclosure.

FIG. 12 is a perspective view of a drain hose and a coupling member of a dishwasher according to a third embodiment of the disclosure and FIG. 13 is a cross sectional view of the drain hose and the coupling member of the dishwasher according to the third embodiment of the disclosure.

According to the third embodiment of the disclosure, the drain hose 100' may include a single hose body 110'. According to the first embodiment of the disclosure, the hose body 101 of the drain hose 100 is formed by combining the first drain hose 110, the second drain hose 130 and the first coupling part 120, but according to another embodiment of the disclosure, the single hose body 110' may be provided.

The drain hose 100' may include a first coupling part 180. The first coupling part 180 may be inserted and injected into the hose body 110'. Accordingly, the hose body 110' and the first coupling part 180 may be integrally formed with each other.

However, the disclosure is not limited thereto, and the hose body 110' and the first coupling part 180 may be injected as one molding. Therefore, the hose body 110' and the first coupling part 180 may be formed as a single injection material. Therefore, the drain hose 100' may be formed as a single injection material.

An inner circumferential surface of a body 181, one end portion 182 and other end portion 183 of the first coupling part 180 may be provided to allow the hose body 110' to be inserted thereto.

An insertion portion 185 of the first coupling part 180 may extend in a direction corresponding to a direction, in which the hose body 110' extends, inside the first coupling part 180.

Accordingly, it is possible to discharge the washing water of the dishwasher 1 using the single hose body 110', thereby improving assembly performance and lowering manufacturing cost.

Hereinafter a drain hose 100' of a dishwasher 1 according to a fourth embodiment of the disclosure will be described. Other than components of the drain hose 100' described below, components of the dishwasher 1 are the same as the dishwasher 1 according to the third embodiment of the disclosure, and thus a description thereof will be omitted.

Figure 14:
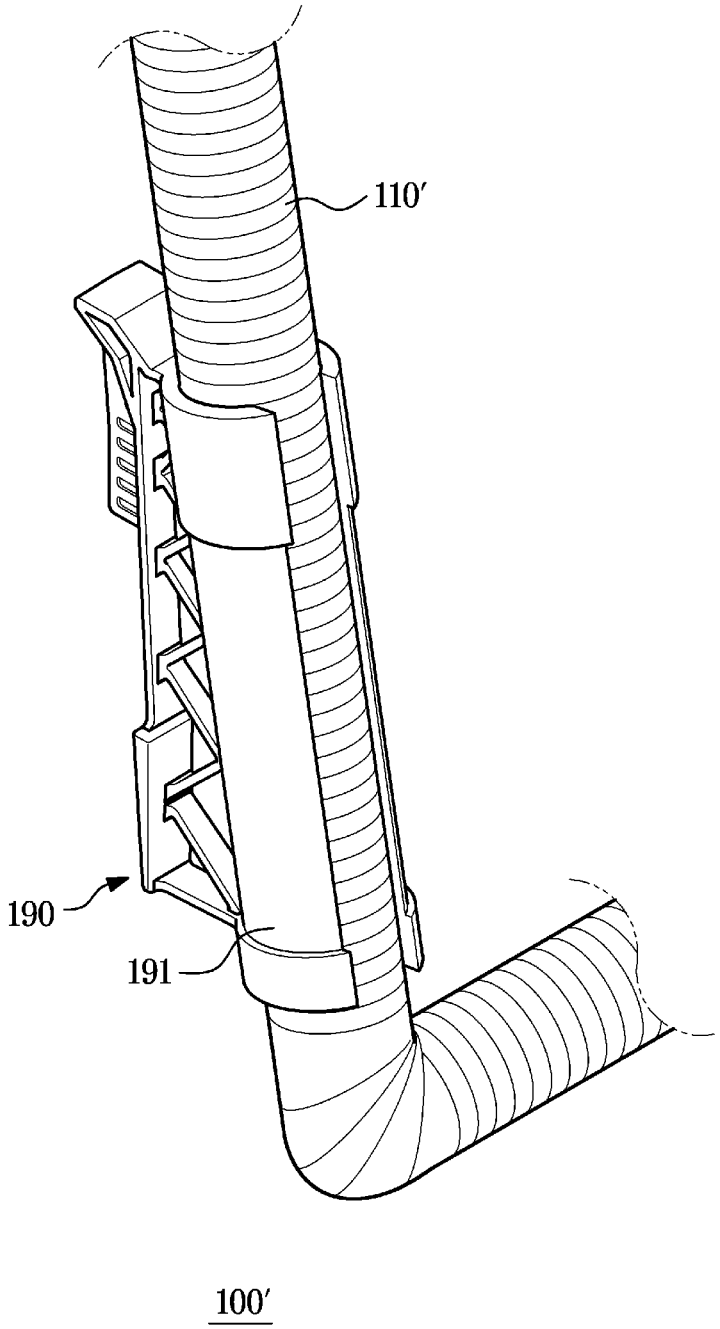
FIG. 14 is a perspective view of a drain hose of a dishwasher according to a fourth embodiment of the disclosure.
Figure 15:
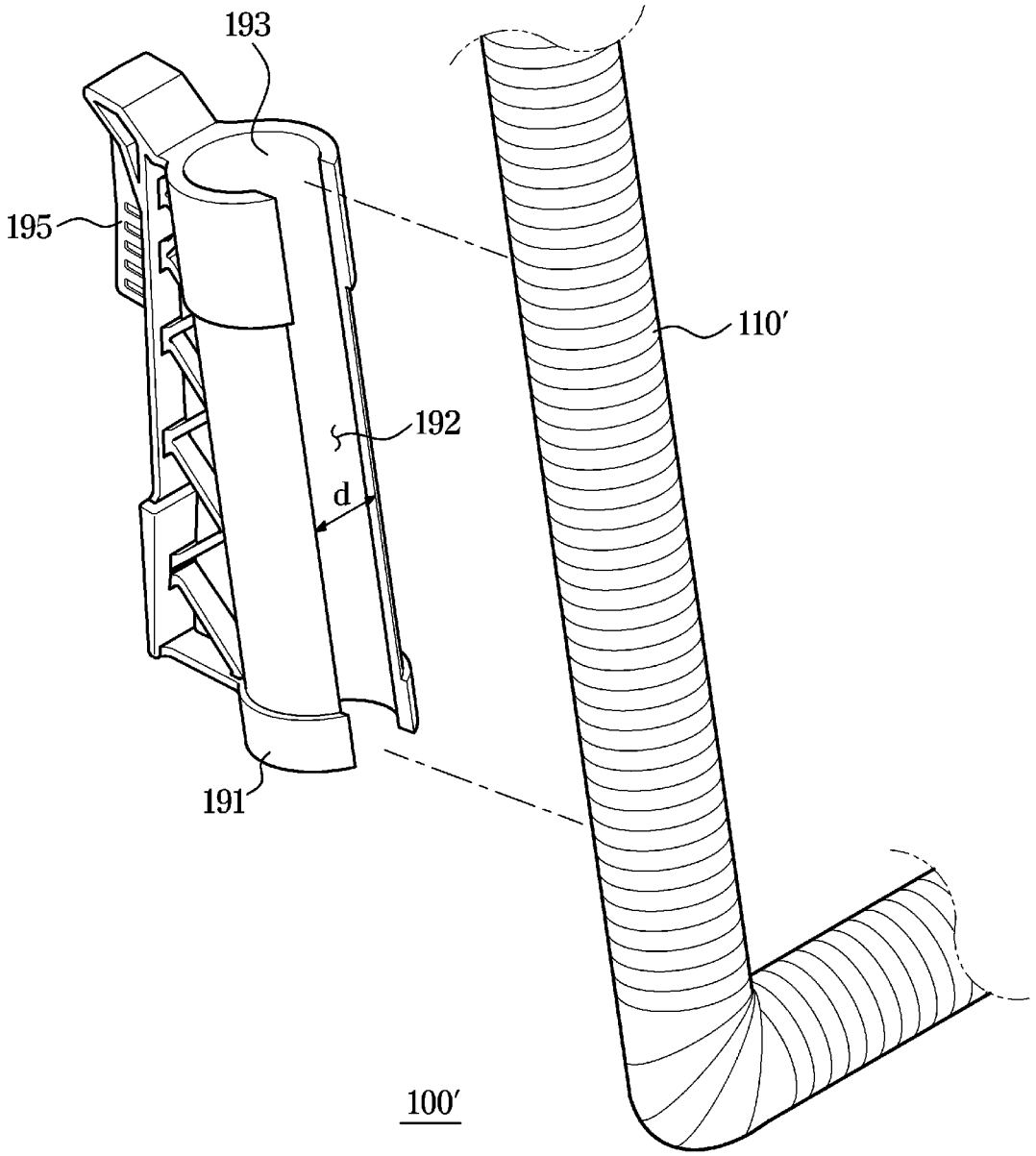
FIG. 15 is an exploded perspective view of the drain hose of the dishwasher according to the fourth embodiment of the disclosure.

FIG. 14 is a perspective view of a drain hose of a dishwasher according to a fourth embodiment of the disclosure and FIG. 15 is an exploded perspective view of the drain hose of the dishwasher according to the fourth embodiment of the disclosure.

The drain hose 100' according to the fourth embodiment of the disclosure may include a single hose body 110' that is the same as the third embodiment of the disclosure.

The drain hose 100' may include a first coupling part 190. The hose body 110' may be removably coupled to the first coupling part 190.

The first coupling part 190 may include a body 191 configured to cover at least a part of an outer circumferential surface of the hose body 110' of the first coupling part 190.

The body 191 may be formed in a tubular shape extending in one direction, and may include a cut out portion 192 in which a part of the tube is cut out outward.

The first coupling part 190 may be separated from the hose body 110' as described above, and the hose body 110' may be inserted into an inside 193 of the body 191 through the cut out portion 192.

A distance D in a direction in which the cut out portion 192 is perpendicular to a longitudinal direction of the body 191 may be less than a diameter of the hose body 110'.

The hose body 110' and the body 191 may be formed of a material having a predetermined elasticity. It is appropriate that the hose body 110' and the body 191 are formed of a plastic injection material.

Because the hose body 110' and the body 191 have the predetermined elasticity, the hose body 110' may be fitted into an interior of the body 191 although the diameter of the drain hose 110' is larger than the width d of the cut out portion 192.

However, the disclosure is not limited thereto, and the distance d in the direction in which the cut out portion 192 is perpendicular to the longitudinal direction of the body 191 may be provided to correspond to the diameter of the hose body 110'. At this time, the first coupling part 190 may include a constraint portion configured to additionally constrain the hose body 110'.

The constraint portion may be served as an additional component configured to couple the hose body 110' to the first coupling part 190 or as an additional portion formed in the body 191.

After the first coupling part 190 is coupled to the hose body 110', the insertion portion 195 may be inserted into the side surface portion 320. Alternatively, after the insertion portion 195 is inserted into the side surface portion 320, the first coupling part 190 may be coupled to the hose body 110.

Accordingly, the assembly order of the drain hose 100' may be improved by changing the coupling order according to the situation.

Hereinafter a side surface portion 320' and a drain hose 100' of a dishwasher 1 according to a fifth embodiment of the disclosure will be described. Other than components of the side surface portion 320' and the drain hose 100' described below, components of the dishwasher 1 are the same as the dishwasher 1 according to the first embodiment of the disclosure, and thus a description thereof will be omitted.

Figure 16:
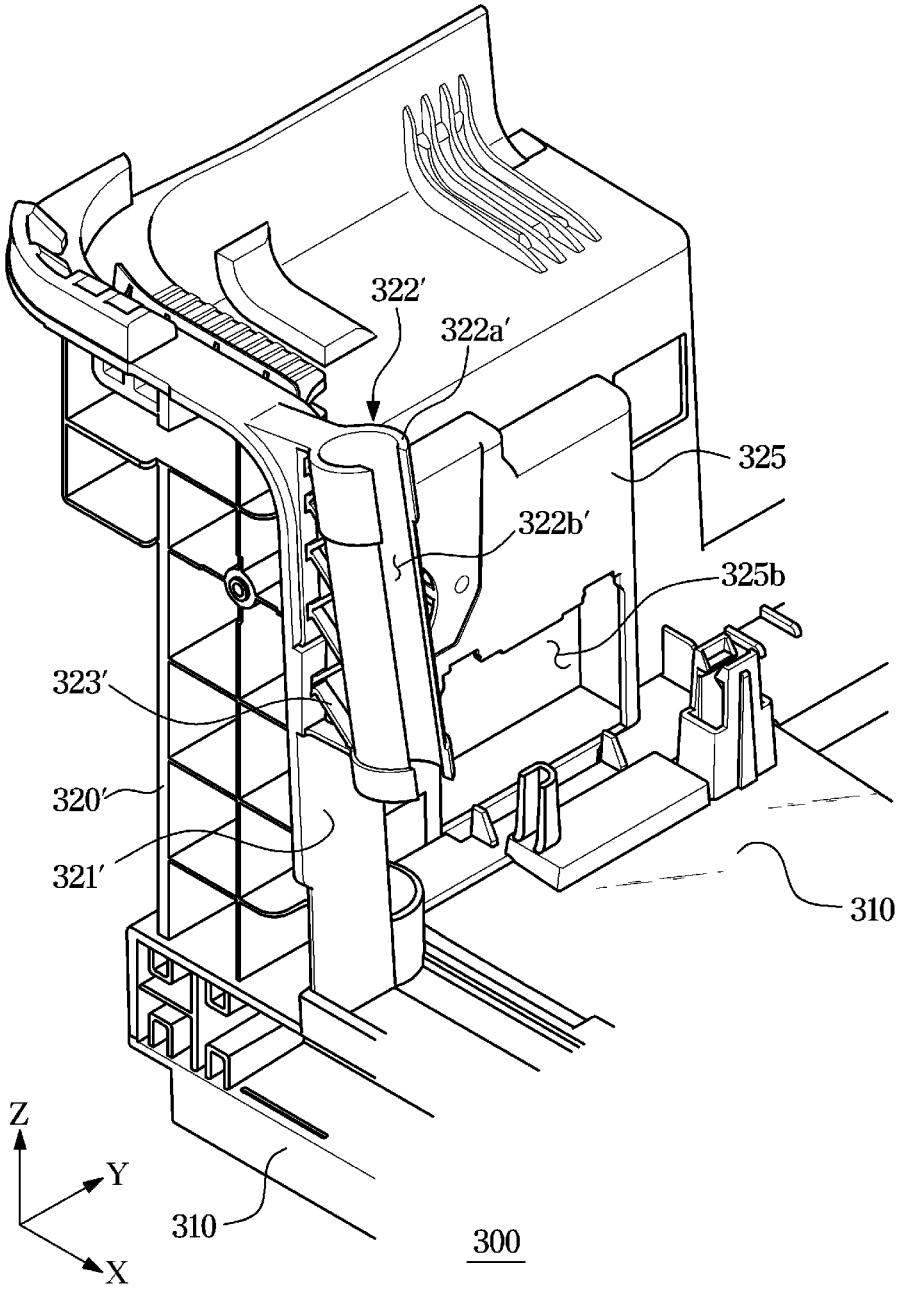
FIG. 16 is a perspective view of a lower frame of a dishwasher according to a fifth embodiment of the disclosure.
Figure 17:
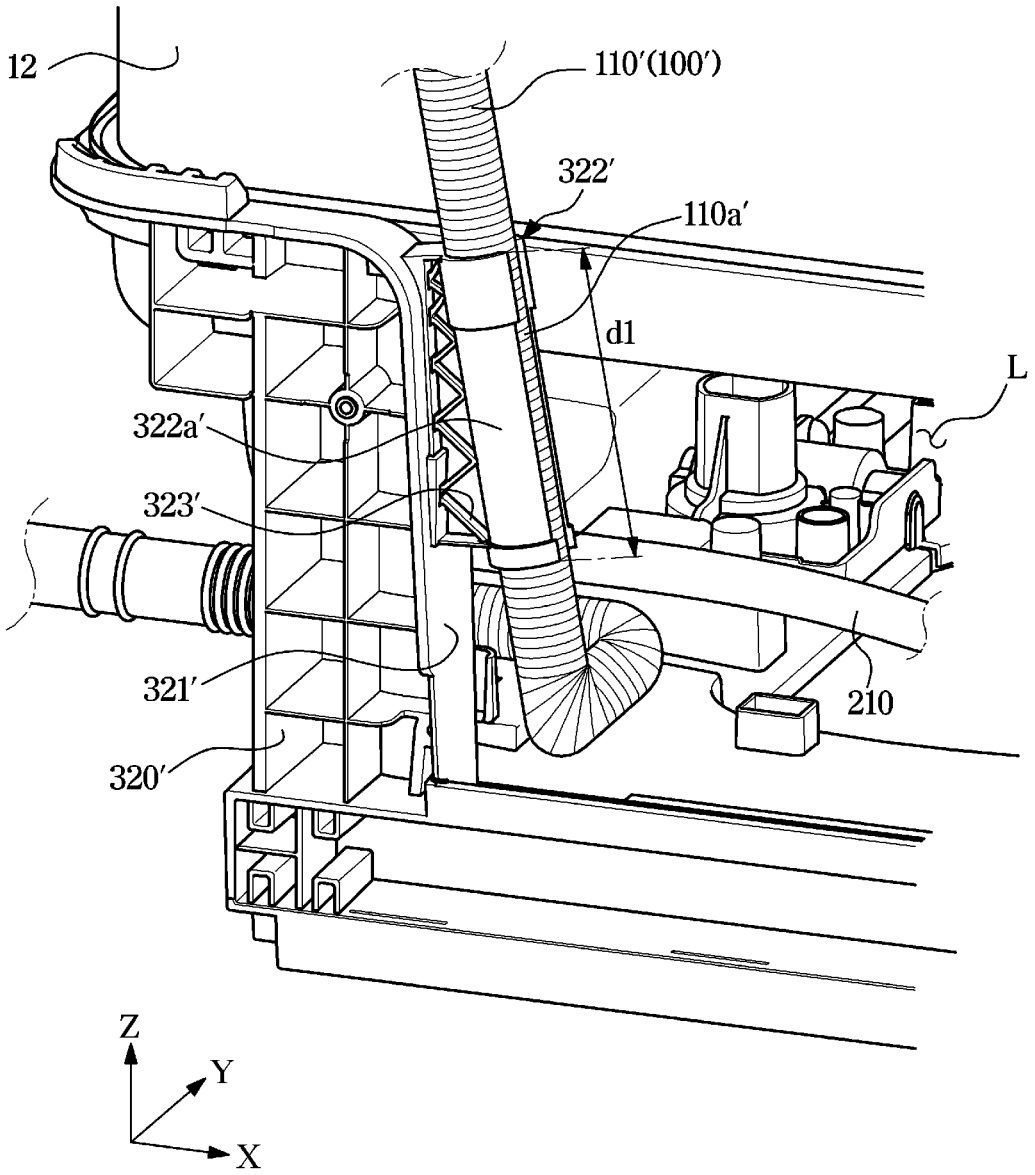
FIG. 17 is a perspective view of a part of the dishwasher according to the fifth embodiment of the disclosure.

FIG. 16 is a perspective view of a lower frame of a dishwasher according to a fifth embodiment of the disclosure and FIG. 17 is a perspective view of a part of the dishwasher according to the fifth embodiment of the disclosure.

The drain hose 100' according to the fifth embodiment of the disclosure may include a single hose body 110' that is the same as the third embodiment of the disclosure.

The side surface portion 320' may surround at least a part of the hose body 110' to allow the hose body 110' to be vertically coupled to the side surface portion 320'.

The drain hose 100' may include a first portion (not shown) formed on the hose body 110' and coupled to the side surface 12*d* of the tub 12, and a second portion 110*a*' coupled to the side surface portion 320'.

The second portion 110*a*' may extend to have a predetermined distance d1, and the side surface portion 320' may be coupled to the drain hose 100' by the predetermined distance d1.

The second portion 110*a*' may be formed longer than the first portion (not shown) in the extending direction of the hose body 110'.

Therefore, in the drain hose 100', a portion coupled to the side surface portion 320' may be longer than a portion coupled to the tub 12.

In addition, as in the above-described embodiments, the drain hose 100' and the tub 12 may be coupled to each other in the front and rear direction X, and the drain hose 100' and the side surface portion 320' may be coupled to each other in the up and down direction Z.

Unlike the above-described embodiments, the drain hose 100' according to the fifth embodiment may not include a coupling part. That is, the drain hose 100' may be formed by the single hose body 110'.

The side surface portion 320' may include a coupling section 322' to which the drain hose 100' is coupled. The hose body 110' may be removably coupled to the coupling section 322'.

The coupling section 322' corresponding to one section of the side surface portion 320' may be integrally formed with the side surface portion 320'. That is, the coupling section 322' may be formed by being integrally injected with the side surface portion 320'.

The side surface portion 320' may include a side wall 321' extending in the up and down direction Z. The coupling section 322 ' may be disposed in the outside of the sidewall 321'.

A rib section 323' may be disposed between the coupling section 322' and the side wall 321'. The rib section 323' may connect the side wall 321' to the coupling section 322'.

By using the rib section 323', the side surface portion 320' may secure strength against external force transmitted from the coupling section 322'.

The side wall 321', the coupling section 322', and the rib section 323' may be formed integrally with the side surface portion 320'. That is, the side wall 321', the coupling section 322', and the rib section 323' may be integrally injected with the side surface portion 320'.

The coupling section 322' may include a body section 322*a*' configured to cover an outer circumferential surface of at least a portion of the second portion 110*a'*.

The body section 322*a*' may be formed in a tubular shape extending in one direction, and may include a cut out portion 322*b*' in which a part of the tube is cut out outward.

The coupling section 322' may be separated from the hose body 110' as described above, and the hose body 110' may be inserted into the inside of the body section 322*a*' through the cut out portion 322*b'*.

That is, the coupling section 322' may be a component corresponding to the component of the first coupling part 190 disclosed in the fourth embodiment, and the coupling section 322' may be formed on the side surface portion 320' without being formed in the drain hose 100'.

Accordingly, because the drain hose 100' formed as a single component is assembled inside the dishwasher 1 and the coupling section 322' to which the drain hose 100' is coupled is integrally formed with the side surface portion 320', it is possible to improve the assembly of the drain hose 100'.

As is apparent from the above description, because the dishwasher includes the coupling member configured to couple the drain hose to the inside of the dishwasher and the drain hose has a minimal number of fixing points by using the coupling member, it is possible to improve the coupling structure of the drain hose and the assembly of the drain hose. Further, by the coupling member, it is possible to improve the strength of the drain hose against the external force.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:
- a main body;
- a tub inside the main body;
- a machine room formed under the tub;
- a sump connected to the tub, and configured to store washing water;
- a hose fixer disposed on a side surface of the tub;
- a first coupler;
- a first drain hose respectively connected to the sump and to the first coupler, the first drain hose including:
  - a second coupler formed thereon, and fixed to the hose fixer to secure the first drain hose to the hose fixer; and
- a second drain hose respectively connected to the first coupler, which is connected to the first drain hose, and to outside of the dishwasher so that the washing water stored in the sump is discharged to the outside through the second drain hose after flowing through the first drain hose, wherein the first coupler comprises:
- a rib portion formed at a side surface of the first coupler, and extending from one end of the first coupler towards an other end of the first coupler; and
- an insertion part extending from the rib portion, and wherein the machine room comprises:
- a lower surface portion forming a base of the dishwasher; and
- a side surface portion extending from the lower surface portion, the side surface portion including:
  - a seating surface formed on one side of the side surface portion, and on which the first coupler is seated; and
  - a slit formed on the one side of the side surface portion, and configured to have the insertion part of the first coupler to be inserted into the slit so as to secure the first coupler to be seated on the seating surface, thereby securing the first drain hose to the side surface portion.

2. The dishwasher of claim 1, wherein the first coupler is coupled to one side of the machine room in an up-and-down direction with respect to the ground.

3. The dishwasher of claim 1, wherein the insertion part comprises a support hook hooked to an inside of the slit to prevent the insertion part from being separated from the slit based on the insertion part being inserted into the slit.

4. The dishwasher of claim 3, wherein the slit is cut out in an up-and-down direction with respect to the ground, and the insertion part is inserted into the slit from an upper side of the slit to a lower side of the slit.

5. The dishwasher of claim 4, wherein the first coupler further comprises a guide part configured to guide the insertion part to be inserted into the slit, and wherein the side surface portion further comprises a guide rail to which the guide part is inserted and slides in a downward direction towards the lower surface portion to guide the insertion part to be inserted into the slit from the upper side of the slit to the lower side of the slit.

6. The dishwasher of claim 1, wherein the first coupler is connected to the first drain hose by inserting one end of the first drain hose into one end of the first coupler so that the one end of the first coupler surrounds an outer circumferential surface of at least a part of the first drain hose first drain hose and the second drain hose are respectively attachable to or detachable from the first coupler.

7. The dishwasher of claim 1, wherein the second drain hose includes one end connected to one end of the first coupler and an other end connected to the outside.

8. The dishwasher of claim 7, further comprising an intermediate part comprising a first end to be connected to the first coupler and a second end to be connected to the second drain hose, and wherein the intermediate part is bent so that the first end of the intermediate part and the second end of the intermediate part are perpendicular to each other.

9. The dishwasher of claim 8, wherein the first coupler is formed of a material having a greater strength than a strength of the intermediate part.

10. The dishwasher of claim 7, further comprising:

a supply hose through which washing water is supplied from an external source; and an air brake assembly disposed on the side surface of the tub, connected to the supply hose, and configured to supply the washing water and air into the tub, the air brake assembly having an air hole which the air is introduced into or discharged from the tub, wherein the hose fixer is disposed in a lower side of the air brake assembly.

11. The dishwasher of claim 10, wherein a distance between the second end of the second drain hose and a section of the first drain hose extending in an up-and-down direction is less than a distance between the second end of the second drain hose and a section of the supply hose extending in the up-and-down direction.

* * * * *